US011436962B2

(12) United States Patent
Furihata et al.

(10) Patent No.: US 11,436,962 B2
(45) Date of Patent: Sep. 6, 2022

(54) DEVICE AND METHOD FOR DRIVING A DISPLAY PANEL

(71) Applicant: Synaptics Incorporated, San Jose, CA (US)

(72) Inventors: Hirobumi Furihata, Tokyo (JP); Masao Orio, Tokyo (JP); Takashi Nose, Kanagawa (JP); Akio Sugiyama, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 3 days.

(21) Appl. No.: 17/148,388

(22) Filed: Jan. 13, 2021

(65) Prior Publication Data

US 2022/0223081 A1 Jul. 14, 2022

(51) Int. Cl.
*G09G 3/20* (2006.01)

(52) U.S. Cl.
CPC ..... *G09G 3/20* (2013.01); *G09G 2310/027* (2013.01); *G09G 2320/0276* (2013.01); *G09G 2320/0285* (2013.01); *G09G 2320/0626* (2013.01); *G09G 2320/0673* (2013.01)

(58) Field of Classification Search
CPC ..... G09G 3/20; G09G 2310/027; G09G 2320/0276; G09G 2320/0285; G09G 2320/0626; G09G 2320/0673
See application file for complete search history.

(56) References Cited

U.S. PATENT DOCUMENTS

2019/0237001 A1* 8/2019 Lin ..... G09G 3/3208
2020/0135147 A1* 4/2020 Tang ..... G09G 3/3208
2021/0134242 A1* 5/2021 Hei ..... G09G 5/02

FOREIGN PATENT DOCUMENTS

CN 111681592 A * 9/2020

* cited by examiner

*Primary Examiner* — Kenneth Bukowski
(74) *Attorney, Agent, or Firm* — Ferguson Braswell Fraser Kubasta PC

(57) ABSTRACT

A display driver includes control circuitry and image processing circuitry. The control circuitry is configured to store first and second predetermined gamma curve defined for first and second regions of a display panel, respectively, the first region having a different pixel layout than the second region. The control circuitry is further configured to determine first and second modified gamma curves by scaling the first and second predetermined gamma curves with a common scale factor. The image processing circuitry is configured to apply a first gamma transformation based on the first modified gamma curve to a first graylevel defined for a first pixel circuit located in the first region to determine a first output voltage level and apply a second gamma transformation based on the second modified gamma curve to a second graylevel defined for a second pixel circuit located in the second region to determine a second output voltage level.

17 Claims, 23 Drawing Sheets

| DBV | 0(Min_lux) | max DBV(Max_lux) |
|---|---|---|
| Scale Factor | $F_scaling = 1/(Target_lux/Max_lux)^{1/\gamma}$ | |
| CPX for First Region |   | Use One X Table |
| CPY for First Region |   | Use One Y Table |
| CPX for Second Region |   | Use One X Table |
| CPY for Second Region |   | Use One Y Table |

DEVICE AND METHOD FOR DRIVING A DISPLAY PANEL

FIELD

The disclosed technology generally relates to a display driver, display device and method for driving a display panel with different pixel layouts.

BACKGROUND

A display panel may include regions with different pixel layouts. In some implementations, a display panel may include regions with different pixel sizes. In other implementations, a display panel adapted to an under-display (or under-screen) camera may include a camera hole region in which the pixel density (which may be measured as pixel-per-inch (PPI)) is reduced compared to the remaining region. The camera hole region may be configured to allow the under-display camera to acquire an image through the camera hole region.

SUMMARY

This summary is provided to introduce in a simplified form a selection of concepts that are further described below in the detailed description. This summary is not intended to identify key features or essential features of the claimed subject matter, nor is it intended to limit the scope of the claimed subject matter.

In one or more embodiments, a display driver is provided. The display driver includes control circuitry and image processing circuitry. The control circuitry is configured to store a first predetermined gamma curve defined for a first region of a display panel and a second predetermined gamma curve defined for a second region of the display panel, the first region having a different pixel layout than the second region. The control circuitry is further configured to determine a first modified gamma curve by scaling the first predetermined gamma curve with a common scale factor and determine a second modified gamma curve by scaling the second predetermined gamma curve with the common scale factor. The common scale factor for scaling the second predetermined gamma curve is the same as the common scale factor for scaling the first predetermined gamma curve. The image processing circuitry is configured to apply a first gamma transformation based on the first modified gamma curve to a first graylevel defined for a first pixel circuit located in the first region to determine a first output voltage level and apply a second gamma transformation based on the second modified gamma curve to a second graylevel defined for a second pixel circuit located in the second region to determine a second output voltage level.

In one or more embodiments, a display device is provided. The display device includes a display panel and a display driver. The display panel includes a first region and a second region, the first region having a different pixel layout than the second region. The display driver includes control circuitry, image processing circuitry, and data driver circuitry. The control circuitry is configured to store a first predetermined gamma curve defined for the first region and a second predetermined gamma curve defined for the second region. The control circuitry is further configured to determine a first modified gamma curve by scaling the first predetermined gamma curve with a common scale factor and determine a second modified gamma curve by scaling the second predetermined gamma curve with the common scale factor. The common scale factor for scaling the second predetermined gamma curve is the same as the common scale factor for scaling the first predetermined gamma curve. The image processing circuitry is configured to apply a first gamma transformation based on the first modified gamma curve to a first graylevel defined for a first pixel circuit located in the first region to determine a first output voltage level and apply a second gamma transformation based on the second modified gamma curve to a second graylevel defined for a second pixel circuit located in the second region to determine a second output voltage level. The data driver circuitry is configured to update the first pixel circuit with the first output voltage level and update the second pixel circuit with the second output voltage level.

In one or more embodiments, a method for controlling a display panel is provided. The method includes determining a first modified gamma curve by scaling a first predetermined gamma curve defined for a first region of a display panel with a common scale factor. The method further includes determining a second modified gamma curve by scaling a second predetermined gamma curve defined for a second region of the display panel with the common scale factor. The first region has a different pixel layout than the second region. The common scale factor for scaling the second predetermined gamma curve is the same as the common scale factor for scaling the first predetermined gamma curve. The method further includes applying a first gamma transformation based on the first modified gamma curve to a first graylevel defined for a first pixel circuit located in the first region to determine a first output voltage level for the first pixel circuit and applying a second gamma transformation based on the second modified gamma curve to a second graylevel defined for a second pixel circuit located in the second region to determine a second output voltage level for the second pixel circuit.

Other aspects of the embodiments will be apparent from the following description and the appended claims.

BRIEF DESCRIPTION OF DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

Figure 1:
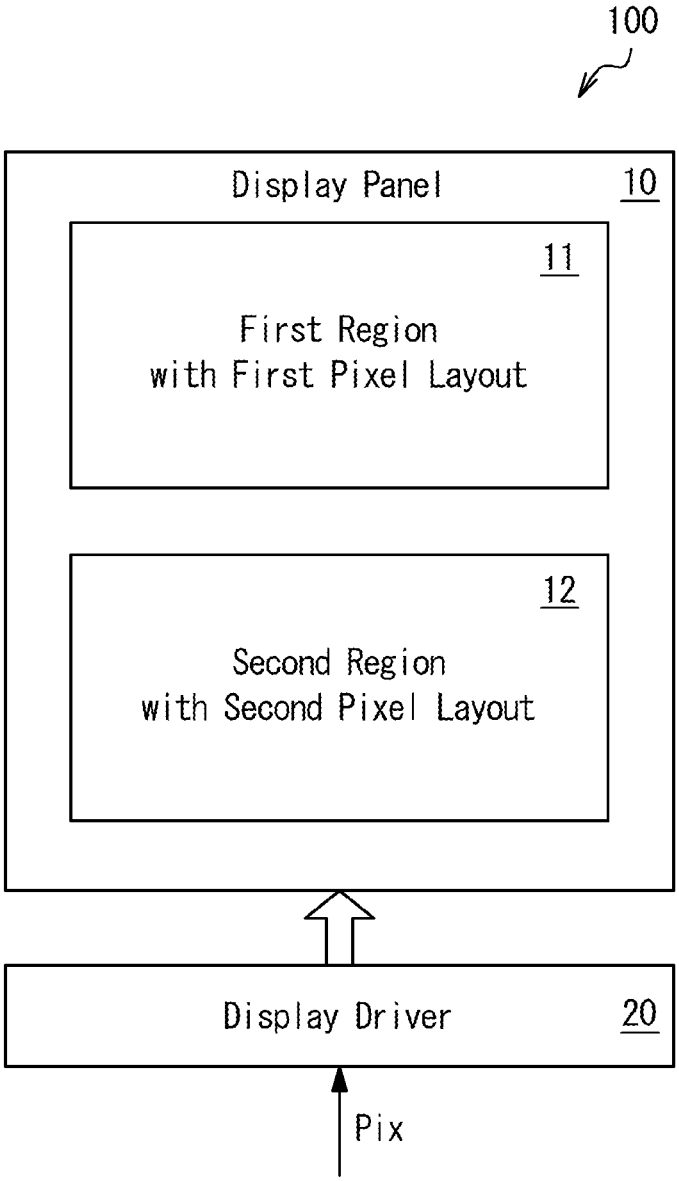
FIG. 1 illustrates an example configuration of a display device that includes a display panel, according to one or more embodiments.

To facilitate understanding, identical reference numerals have been used, where possible, to designate identical elements that are common to the figures. It is contemplated that elements disclosed in one embodiment may be beneficially utilized on other embodiments without specific recitation. Suffixes may be attached to reference numerals for distinguishing identical elements from each other. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

A display panel may include two or more regions of different pixel layouts. The pixel layout difference may include a difference in one or more of the size, configuration, and arrangement of the pixels and/or a difference in one or more of the size, configuration, arrangement, and number of subpixels in each pixel. Such a display device may be configured to display a continuous image over the two or more regions of different pixel layouts.

The pixel layout difference may cause image artifact at the boundary between adjacent regions due to a difference in the display characteristics resulting from the different pixel layouts. One approach for mitigating or eliminating the image artifact is to update or program the pixels disposed in the regions in accordance with different gamma curves. The "gamma curve" referred herein is a curve that defines a correlation of graylevels with output voltage levels with which each subpixel is updated.

In some implementations, the gamma curves defined for the respective regions may be adjusted to control the display brightness level of the display panel, where the display brightness level may be the brightness of the entire image displayed on the display panel. An improper gamma curve adjustment scheme may however cause undesired changes in the display characteristics, e.g., the brightness, chromaticity, gamma characteristics, or the like.

The present disclosure provides a gamma curve adjustment scheme for mitigating or eliminating undesired changes in the display characteristics. In one or more embodiments, a first predetermined gamma curve is defined for a first region of a display panel and a second predetermined gamma curve is defined for a second region of the display panel, where the first region has a different pixel layout than the second region. A first modified gamma curve used for a first gamma transformation for the first region is determined by scaling the first predetermined gamma curve with a common scale factor, while a second modified gamma curve used for a second gamma transformation for the second region is determined by scaling the second predetermined gamma curve with the common scale factor. The common scale factor for scaling the second predetermined gamma curve is the same as the common scale factor for scaling the first predetermined gamma curve. The use of the common scale factor may effectively mitigate an undesired change in the display characteristics.

FIG. 1 illustrates an example configuration of a display device 100 that includes a display panel 10 including multiple regions with different pixel layouts, according to one or more embodiments. Examples of the display panel 10 may include an organic light emitting diode (OLED) display, a micro light emitting diode (LED) display, and a liquid crystal display (LCD) panel. In the illustrated embodiment, the display panel 10 includes a first region 11 with a first pixel layout and a second region 12 with a second pixel layout different from the first pixel layout. The display panel 10 may be connected to a display driver 20 configured to drive the display panel 10 based on input image data Pix.

Figure 2:
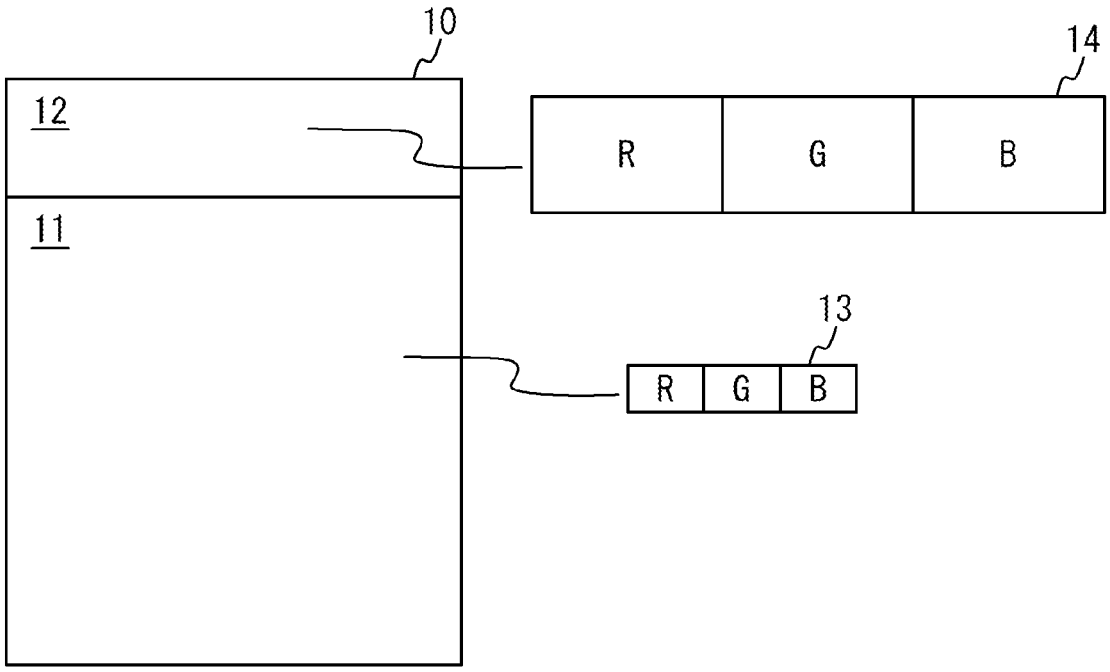
FIG. 2 illustrates example pixel layouts in a first region and a second region of a display panel, according to one or more embodiments.

FIG. 2 illustrates example pixel layouts in the first region 11 and the second region 12, according to one or more embodiments. Although only two regions are shown, more than two regions may exist without departing from the scope of one or more embodiments. In the illustrated embodiment, the first region 11 includes a plurality of pixels 13 (one illustrated) and the second region 12 includes a plurality of pixels 14 (one illustrated). Each of the pixels 13 and 14 include subpixels configured to display a distinct color. As shown in FIG. 2, the subpixels may be "R", "G", and "B" which corresponding to red, green, and blue, respectively, and may hereinafter be referred to as R subpixels, G subpixels, and B subpixels, respectively. Each subpixel may include a pixel circuit configured to display red, green, or blue, and each pixel circuit may include a light emitting element (e.g., an OLED and an LED). In such implementation, the R, G, and B subpixels may include light emitting elements configured to emit light of red, green and blue, respectively.

In the embodiment illustrated in FIG. 2, the size of the pixels 14 disposed in the second region 12 is larger than the size of pixels 13 disposed in the first region 11. In one implementation, the height and width of the pixels 14 in the second region 12 may be, but not limited to, twice those of the pixels 13 in the first region 11. In embodiments where each of the R, G, and B subpixels of the pixels 13 and 14 includes a light emitting element, the sizes of the light emitting elements of the R, G, and B subpixels of the pixels 13 may be larger than those of the pixels 14. Each of the pixels 13 and 14 may further include at least one additional subpixel configured to display a color other than red, green, and blue. For example, each pixel may further include a subpixel configured to display white or yellow. In the example, the subpixels may include R, G, B, and white subpixels, or R, G, B, and yellow subpixels.

Figure 3:
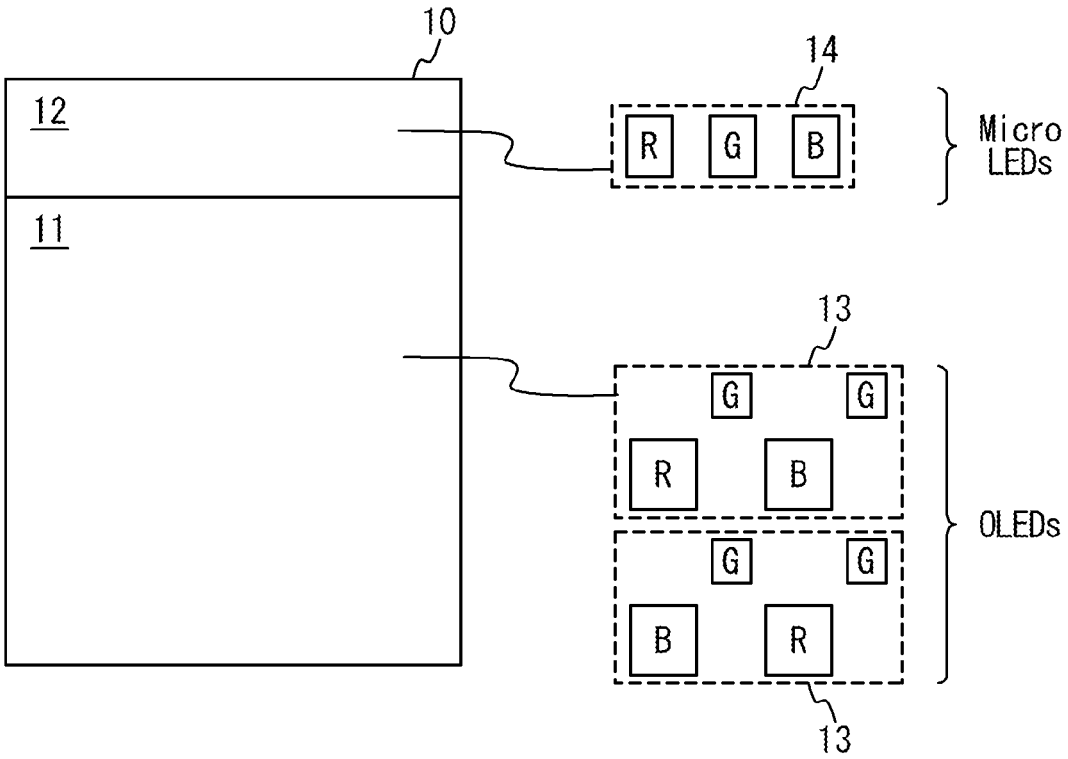
FIG. 3 illustrates example pixel layouts in a first region and a second region of a display panel, according to other embodiments.

FIG. 3 illustrates example pixel layouts in the first region 11 and the second region 12, according to other embodiments. In the illustrated embodiment, the configuration of pixels 13 (two illustrated) disposed in the first region 11 is different from that of pixels 14 (one illustrated) disposed in the second region 12. In one or more embodiments, the pixels 13 and 14 may include different types of light emitting elements. In the illustrated embodiment, the pixels 13 disposed in the first region 11 each include four subpixels each including an OLED, one R subpixel configured to emit red light, two G subpixels configured to emit green light, and one B subpixel configured to emit blue light. The two G subpixels may be sized such that the total size of the two G subpixels is the same as the R subpixel and the B subpixel. The pixel layout of the first region 11 illustrated in FIG. 3 may allow use of a subpixel rendering technique. The pixels 14 disposed in the second region 12 each include three subpixels each including a micro LED, one R subpixel configured to emit red light, one G subpixel configured to emit green light, and one B subpixel configured to emit blue light.

Figure 4:
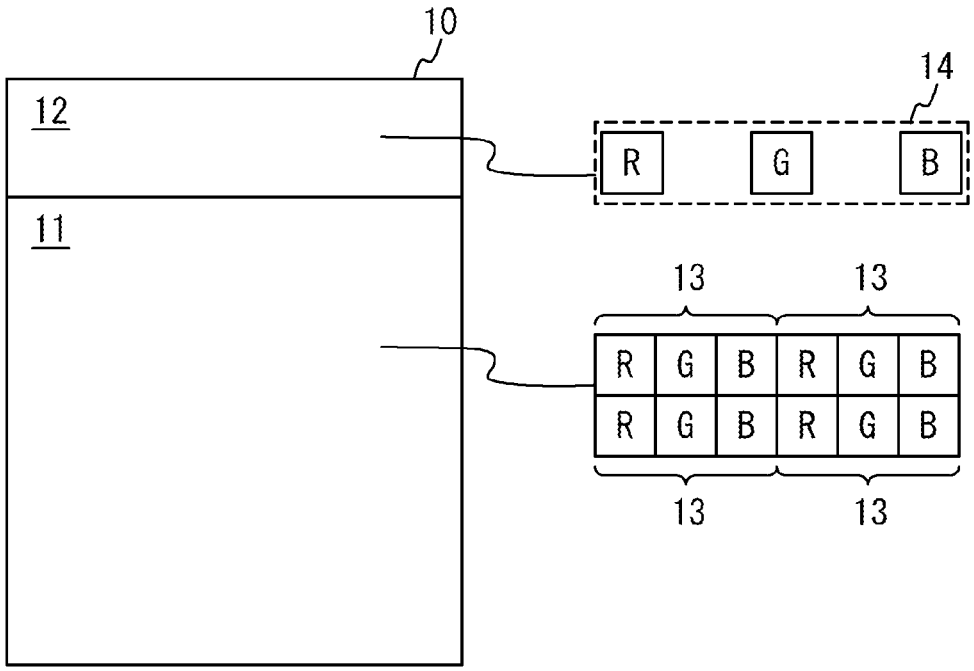
FIG. 4 illustrates example pixel layouts in a first region and a second region of a display panel, according to still other embodiments.

FIG. 4 illustrates example pixel layouts in the first region 11 and the second region 12, according to still other embodiments. The configuration of pixels 13 (two illustrated) disposed in the first region 11 is different from that of pixels 14 (one illustrated) disposed in the second region 12 in this illustrated embodiment. The pixels 13 disposed in the first region 11 and pixels 14 disposed in the second region 12 each include three subpixels configured to emit light of red, green, and blue. In the illustrated embodiments, the pixel circuits of the pixels 13 in the first region 11 are arranged more densely than those of the pixels 14 in the second region 12 such that the first region 11 has a higher pixel density (which may be measured as pixel-per-inch (PPI)) than the second region 12.

Figure 5:
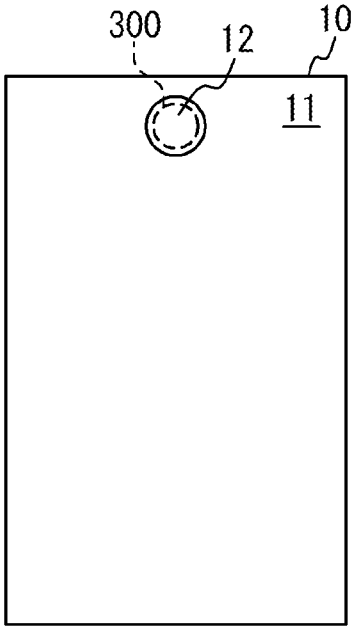
FIG. 5 illustrates an example configuration of a display panel, according to one or more embodiments.

FIG. 5 illustrates another example configuration of the display panel 10, according to one or more embodiments. The shapes of the first region 11 and the second region 12 may be variously modified. In the illustrated embodiment, the second region 12 is defined as a circular portion of the display panel 10 and the first region 11 is defined as the remaining portion. The second region 12 may be used as a camera hole region under which an under-display camera 300 is disposed. In such embodiments, the second region 12 may have a lower pixel density than that of the first region 11, and the size of pixels 14 disposed in the second region 12 may be smaller than the size of pixels 13 disposed in the first region 11.

Referring to FIGS. 1 to 5, the display device 100 may be configured to display a continuous image over the first region 11 and the second region 12. In such implementations, one issue may be that the difference in the pixel layout may cause a difference in the display characteristics between the first region 11 and the second region 12. The difference in the display characteristics may cause image artifact at the boundary between the first region 11 and the second region 12.

Figure 6:
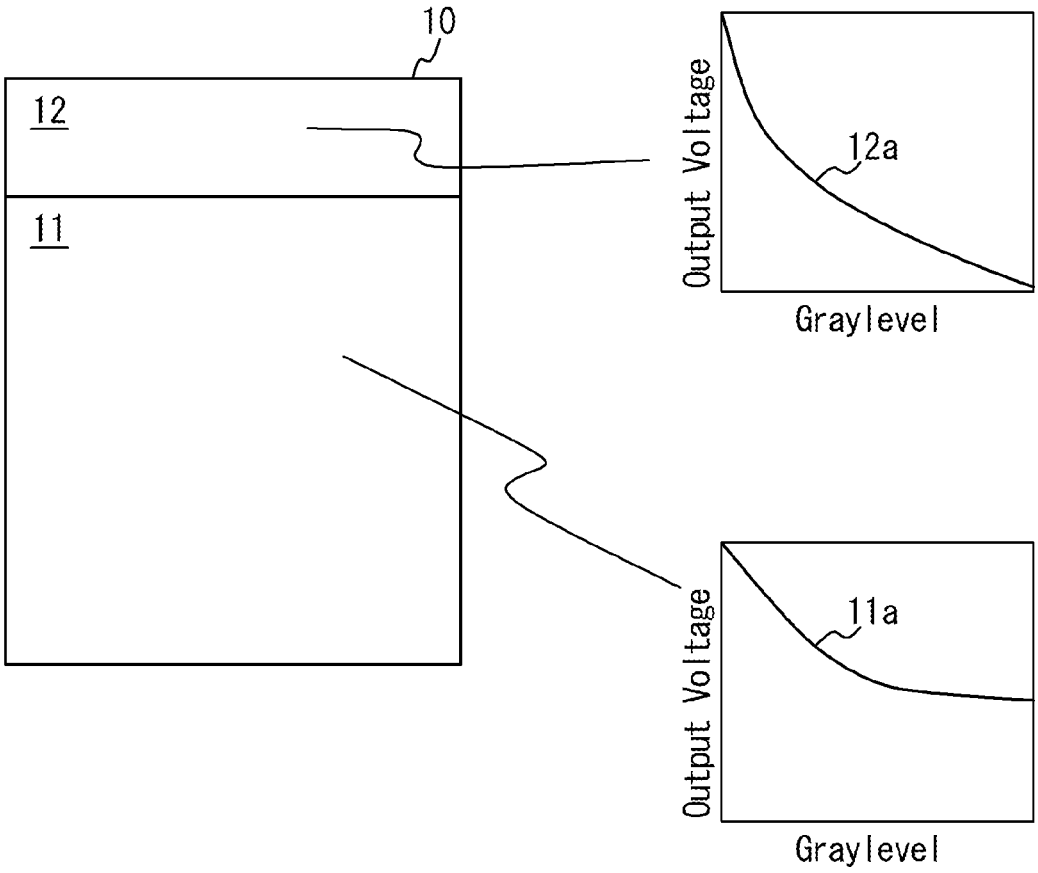
FIG. 6 illustrates example gamma curves defined for a first region and a second region of a display panel, respectively, according to one or more embodiments.

One approach for mitigating or eliminating the image artifact is to update or program the pixels 13 disposed in the first region 11 and the pixels 14 disposed in the second region 12 in accordance with different gamma curves. The "gamma curve" referred herein is a curve that defines a correlation of graylevels with output voltage levels with which each subpixel is updated. FIG. 6 illustrates example gamma curves 11*a* and 12*a* defined for the first region 11 and the second region 12, respectively, according to one or more embodiments. In embodiments where the luminance of each pixel circuit of each pixel 13 and 14 increases as the output voltage level decreases, the gamma curves 11*a* and 12*a* are defined such that the output voltage level decreases as the graylevel increases, as illustrated in FIG. 6. The shapes of the gamma curve 11*a* and 12*a* are defined differently to absorb the difference in the display characteristics between the first region 11 and the second region 12 such that the brightness of the first region 11 is the same as that of the second region 12.

The gamma curves defined for the first region 11 and the second region 12 may be adjusted in response to a display brightness value (DBV). In one or more embodiments, the DBV is a control parameter that controls the display brightness level of the display device 100. The display brightness level may be the brightness of the entire image displayed on the display panel 10. The display driver 20 is configured to update the pixels 13 and 14 of the display panel 10 based on the DBV to achieve a desired brightness level. The DBV may be generated and received from an entity external to the display driver 20 (e.g., a host, an application processor, a central processing unit). The DBV may be generated based on a user operation. For example, when an instruction to adjust the brightness of an image displayed on the display device 100 is manually input to an input device (not illustrated), the DBV may be generated based on this instruction to adjust the display brightness level. The input device may include a touch panel disposed on at least a portion of the display panel 10, a cursor control device, and mechanical and/or non-mechanical buttons.

Figure 7A:
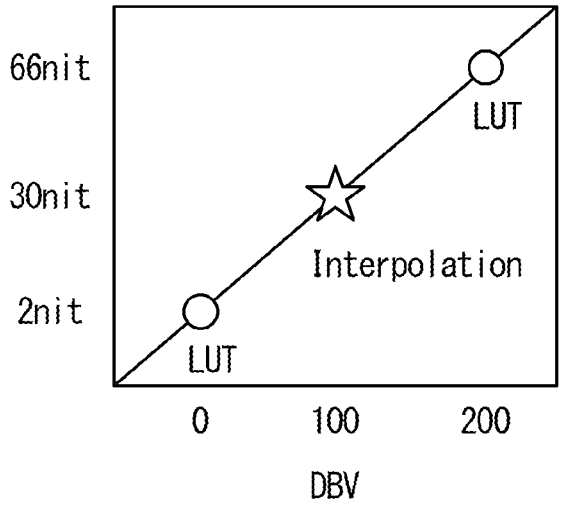
FIG. 7A illustrates an example correlation of display brightness values (DBVs) with display brightness levels, according to one or more embodiments.

FIG. 7A illustrates an example correlation of the DBV with the display brightness level. In one or more embodiments, the display brightness level increases as the DBV increases. In the illustrated embodiment, a DBV of "0" corresponds to a display brightness level of 2 nit and a DBV of "200" corresponds to a display brightness level of 66 nit. One approach to achieve such correlation is to prepare multiple lookup tables (LUTs) that respectively define gamma curves for corresponding DBVs. In the illustrated embodiment, two LUTs are prepared to define gamma curves for the DBVs of 0 and 200, respectively.

For a DBV for which no LUT is defined, the gamma curve for the DBV may be defined through interpolation of two LUTs associated with the nearest two DBVs for which LUTs are defined. For example, the gamma curve for a DBV of 100 (as denoted by a star in FIG. 7A) may be defined through interpolation of the LUTs defined for the DBVs of 0 and 200 as illustrated in FIG. 7A.

Figure 7B:
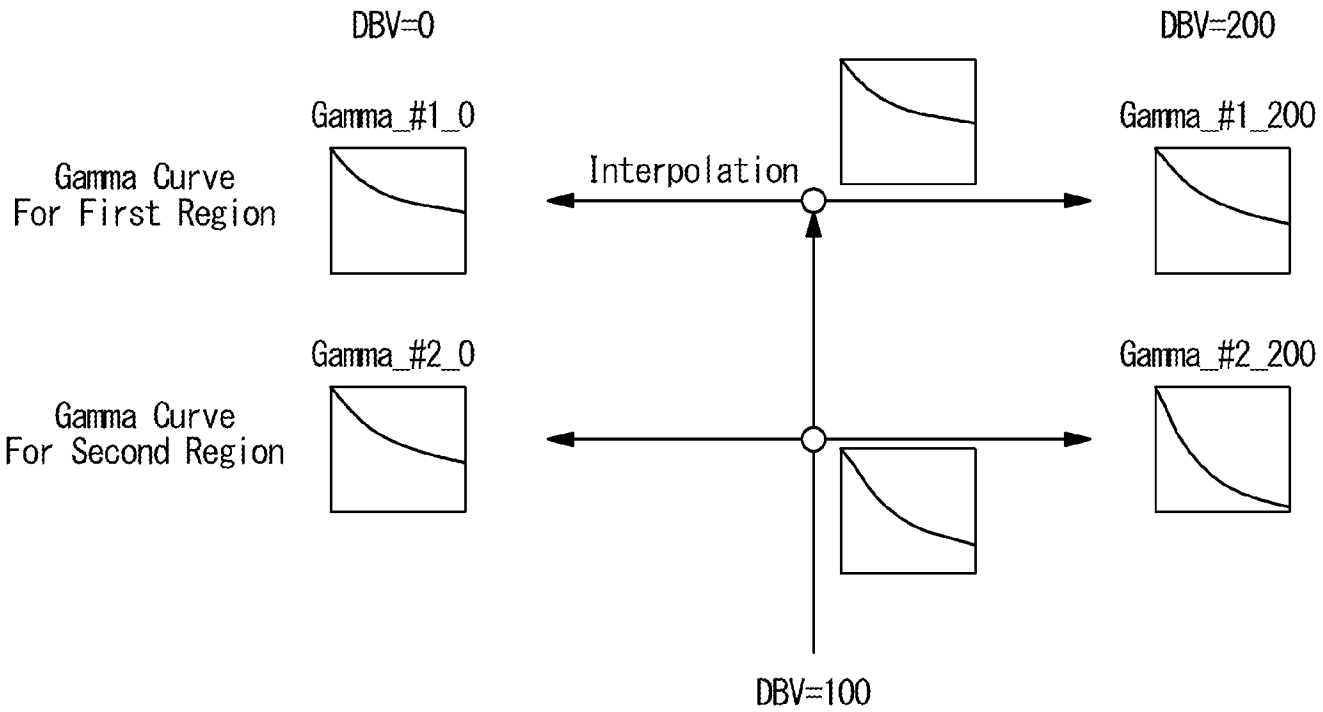
FIG. 7B illustrates example interpolation of lookup tables (LUTs) for a first region and a second region, according to one or more embodiments.

One issue may be that interpolation of two LUTs may cause a difference in the brightness between the first region 11 and the second region 12 due to the difference in the pixel layouts. FIG. 7B illustrates example interpolation of LUTs for the first region 11 and the second region 12. In the illustrated example, a pair of LUTs Gamma_#1_0 and Gamma_#1_200 define gamma curves for the DBVs of 0 and 200, respectively, for the first region 11, and a pair of LUTs Gamma_#2_0 and Gamma_#2_200 define gamma curves for the DBVs of 0 and 200, respectively, for the second region 12. For the DBV of 100, the gamma curve for the first region 11 may be defined through interpolation of the LUTs Gamma_#1_0 and Gamma_#1_200, and the gamma curve for the second region 12 may be defined through interpolation of the LUTs Gamma_#2_0 and Gamma_#2_200. Such interpolation may however cause a difference in the brightness between the first region 11 and the second region 12 due to the non-linearity of the correlation of the output voltages with the luminances of the pixels 13 and 14.

The difference in the brightness between the first region 11 and the second region 12 may be reduced by preparing an increased number of LUTs to define gamma curves for an increased number of DBVs. This approach may however increase hardware used for the gamma transformation. The present disclosure provides a technique for reducing or eliminating a difference in the display brightness level between regions with different pixel layouts.

Figure 8:
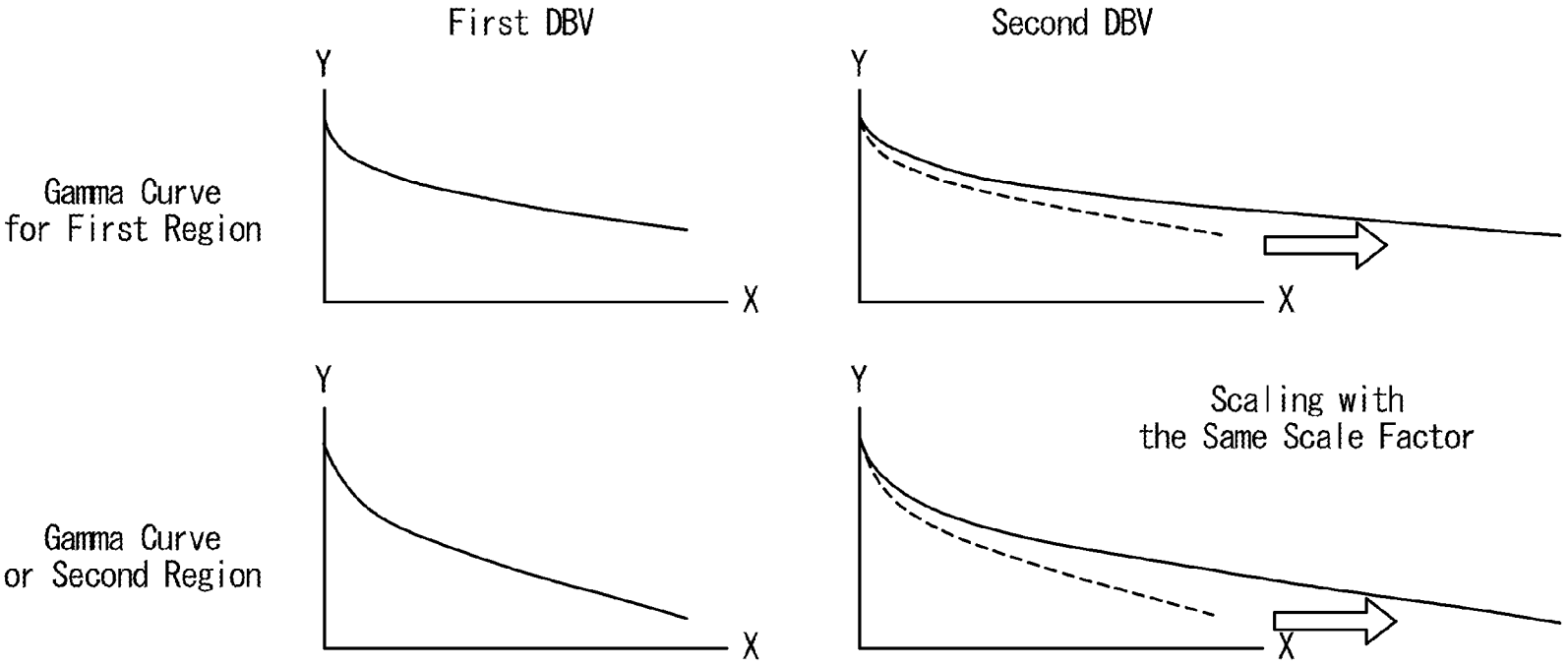
FIG. 8 illustrates an example scheme to reduce or eliminate a difference in the brightness between regions with different pixel layouts, according to one or more embodiments.

FIG. 8 illustrates an example scheme to reduce or eliminate a difference in the display brightness level between regions with different pixel layouts, according to one or more embodiments. In one or more embodiments, a first gamma curve is predetermined for a first region (e.g., the first region 11) of a display panel (e.g., the display panel 10) and a second gamma curve is predetermined for a second region (e.g., the second region 12) of the display panel. The first region has a different pixel layout than the second region. The first predetermined gamma curve and the second predetermined gamma curve may be associated with a first DBV. To achieve a desired display brightness level for a second DBV, a first modified gamma curve is determined by scaling the first predetermined gamma curve with a common scale factor and a second modified gamma curve is determined by scaling the second predetermined gamma curve with the common scale factor, where the common scale factor is a numerical value indicating the ratio by which both the first and second predetermined gamma curves are scaled. The common scale factor for scaling the second predetermined gamma curve is the same as the common scale factor for scaling the first predetermined gamma curve. In one or more embodiments, the common scale factor is based on the second DBV.

A first gamma transformation based on the first modified gamma curve is applied to a first graylevel defined for a first pixel circuit located in the first region to determine a first output voltage level, and a second gamma transformation based on the second modified gamma curve is applied to a second graylevel defined for a second pixel circuit located in the second region to determine a second output voltage level. In various embodiments, the first predetermined gamma curve and the second predetermined gamma curve are scaled with the common scale factor along an axis that represents graylevels, which is the horizontal axis in FIG. 8. The scaling of the gamma curves with the common scale factor may reduce the difference in the brightness of the first and second regions in controlling the display brightness level in response to the DBV.

Figure 9:
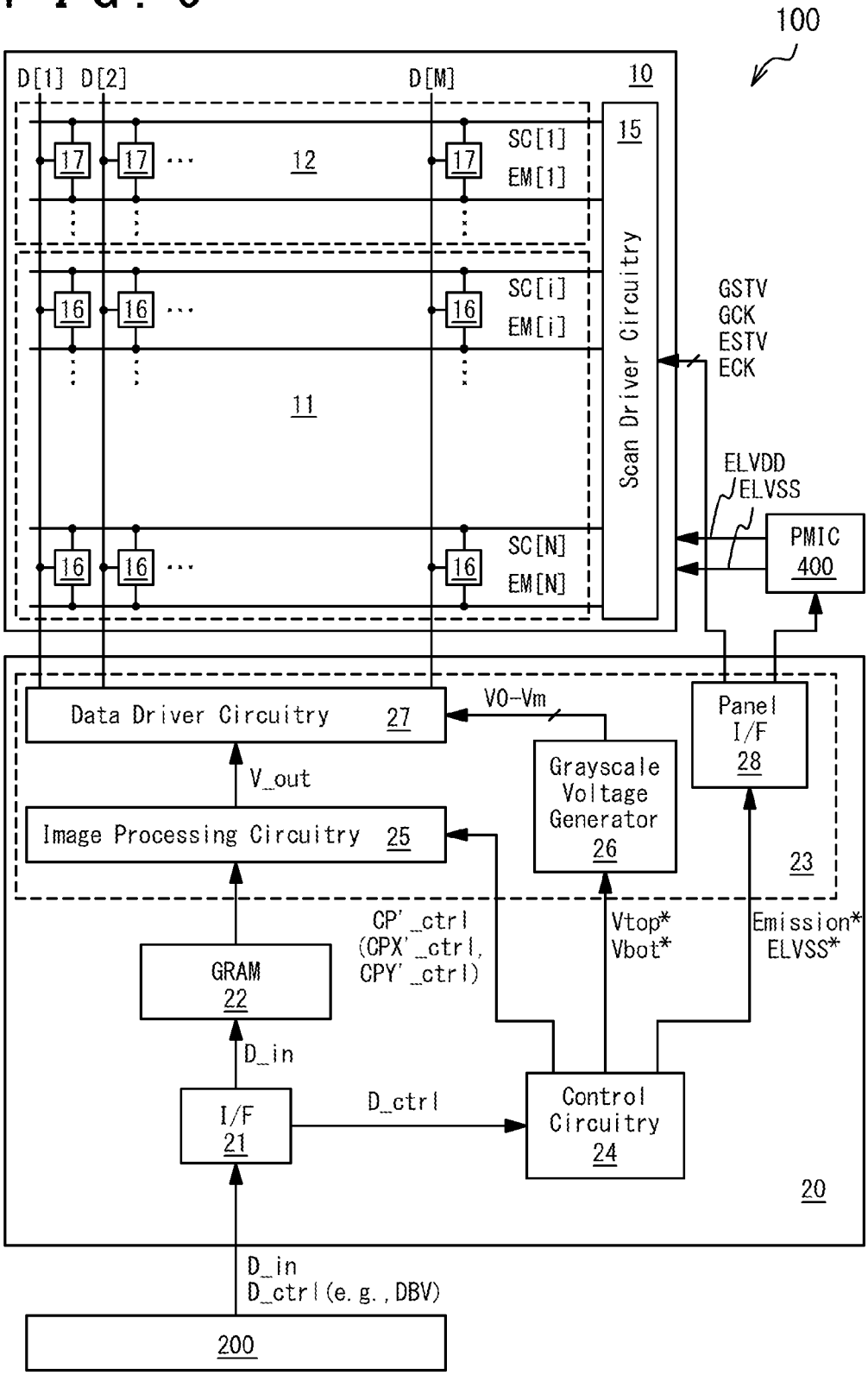
FIG. 9 illustrates an example detailed configuration of a display device, according to one or more embodiments.

FIG. 9 illustrates an example detailed configuration of the display device 100, according to one or more embodiments. In the illustrated embodiment, the display device 100 is configured to display an image corresponding to input image data D_in received from an entity 200 external to the display device 100. Examples of the entity 200 may include a host, an application processor, a central processing unit (CPU), or other processors. The display device 100 includes a display panel 10 and a display driver 20. The display panel 10 may include a self-luminous display panel, such as an organic light emitting diode (OLED) display panel and a micro light emitting diode (LED) display panel. In other embodiments, the display panel 10 may be a liquid crystal display panel or a different type of display panel.

In the illustrated embodiment, the first region 11 of the display panel 10 includes pixel circuits 16 used as subpixels of the pixels 13, and the second region 12 includes pixel circuits 17 used as subpixels of the pixels 14. The display panel 10 further includes N gate scan lines SC [1] to SC [N], N emission scan lines EM [1] to EM [N], M data lines D [1] to D [M], and scan driver circuitry 15. The gate scan lines SC [1] to SC [N] and the N emission scan lines EM [1] to EM [N] are coupled to the scan driver circuitry 15 and the data lines D [1] to D [M] are coupled to the display driver 20. The gate scan lines SC [1] to SC [N] and the emission scan lines EM [1] to EM [N] are extended in the horizontal direction of the display panel 10, and the data lines D [1] to D [M] are extended in the vertical direction. Each of the pixel circuits 16 and 17 is coupled to a corresponding gate scan line SC, emission scan line EM, and data line D.

The pixel circuits 16 and 17 are each configured to be programmed or updated with an output voltage received from the display driver 20. In one or more embodiments, programming or updating a pixel circuit 16 or 17 connected to the gate scan line SC [i], the emission scan line EM [i], and the data line D [j] may be achieved by asserting the gate scan line SC [i] in a state in which the emission scan line EM [i] is deasserted and the output voltage is supplied to the data line D [j]. The pixel circuits 16 and 17 are each further configured to emit light with a luminance corresponding to the output voltage. In one or more embodiments, the pixel circuits 16 and 17 may be each configured such that the luminances of the pixel circuits 16 and 17 increase as the output voltages decrease. This may be the case when the display panel 10 is configured as an OLED display panel in which p-channel thin-film transistors (TFTs) are used in the pixel circuits 16 and 17.

The light emission from the pixel circuits 16 and 17 is controlled by the emission scan lines EM [1] to EM [N]. The pixel circuits 16 or 17 connected to the emission scan line EM [i] are configured to emit light when the emission scan line EM [i] is asserted, not emitting light when deasserted.

The display panel 10 further includes scan driver circuitry 15. The scan driver circuitry 15 is configured to select pixel circuits 16 or 17 to be programmed or updated by the gate scan lines SC [1] to SC [N] and the emission scan lines EM [1] to EM [N]. The scan driver circuitry 15 is configured to assert the gate scan line SC [i] while deasserting the emission scan line EM [i] when pixel circuits 16 or 17 connected to the gate scan line SC [i] and the emission scan line EM [i] are programmed or updated. The scan driver circuitry 15 is configured to sequentially assert the gate scan lines SC to program or update the pixel circuits 16 and 17. The assertion and deassertion of the gate scan lines SC [1] to SC [N] may be controlled based on a gate scan control signal GSTV in synchronization with a gate clock GCK, where the gate scan control signal GSTV and the gate clock GCK are received from the display driver 20.

The scan driver circuitry 15 is further configured to control light emission from the pixel circuits 16 and 17 by the emission scan lines EM [1] to EM [N]. In displaying an image, selected ones of the emission scan lines EM [1] to EM [N] are asserted to allow the pixel circuits 16 and 17 connected thereto to emit light, and the selection of the asserted emission scan lines EM is successively shifted over the array of the emission scan lines EM in synchronization with an emission clock ECK received from the display driver 20. The assertion and deassertion of the emission scan lines EM [1] to EM [N] are controlled based on an emission control signal ESTV received from the display driver 20.

In one or more embodiments, the emission control signal ESTV is generated as a pulse-width modulated (PWM) signal and the display brightness level of the display device 100 is controlled by the duty ratio of the emission control signal ESTV. The duty ratio of the emission control signal ESTV may correspond to the ratio of a period during which the emission control signal ESTV is asserted to one cycle period of the emission control signal ESTV. In one or more embodiments, when the duty ratio of the emission control signal ESTV increases, the ratio of the number of asserted emission scan lines EM to the total number of the emission scan lines EM increases, and the ratio of the pixel circuits 16 and 17 that emit light to the total number of pixel circuits 16 and 17 also increases, resulting in an increase in the display brightness level of the display device 100.

The display panel 10 is configured to receive a high-side power source voltage ELVDD and a low-side power source voltage ELVSS from a power management integrated circuit (PMIC) 400. The high-side power source voltage ELVDD and the low-side power source voltage ELVSS are delivered to the respective pixel circuits 16 and 17 via power source lines (not illustrated.)

In one or more embodiments, the display driver 20 is configured to control the display panel 10 based on input image data D_in and control data D_ctrl received from the external entity 200 to display an image corresponding to the input image data D_in on the display panel 10. The input image data D_in may include graylevels defined for the pixel circuits 16 and 17 of the display panel 10. The control data D_ctrl may include a display brightness value (DBV) specified by the external entity 200. In the illustrated embodiment, the display driver 20 includes interface (I/F) circuitry 21, a graphic random-access memory (GRAM) 22, signal supply circuitry 23, and control circuitry 24.

In one or more embodiments, the interface circuitry 21 is configured to receive the input image data D_in and the control data D_ctrl from the external entity 200. The interface circuitry 21 may be further configured to forward the input image data D_in to the GRAM 22 and forward the control data D_ctrl to the control circuitry 24. In other embodiments, the interface circuitry 21 may be configured to process the input image data D_in and send the processed input image data D_in to the GRAM 22.

The GRAM 22 is configured to temporarily store the input image data D_in received from the interface circuitry 21 and forward the input image data D_in to the signal supply circuitry 23. In other embodiments, the GRAM 22 may be omitted and the input image data D_in may be directly transferred from the interface circuitry 21 to the signal supply circuitry 23.

The signal supply circuitry 23 is configured to supply various signals to the display panel 10 under control of the control circuitry 24. The signals supplied to the display panel 10 may include the output voltages with which the pixel circuits 16 and 17 are programmed or updated, the gate scan control signal GSTV, the gate clock GCK, the emission control signal ESTV, the emission clock ECK. In the illustrated embodiment, the signal supply circuitry 23 includes image processing circuitry 25, grayscale voltage generator 26, data driver circuitry 27, and panel interface (I/F) circuitry 28.

In one or more embodiments, the image processing circuitry 25 is configured to process the input image data D_in received from the GRAM 22 to generate output voltage data V_out. The output voltage data V_out may include voltage values that specify the output voltage levels with which the respective pixel circuits 16 and 17 of the display panel 10 are to be programmed or updated.

The processing performed by the image processing circuitry 25 includes a gamma transformation to convert graylevels to output voltage levels. The gamma transformation for the pixel circuits 16 in the first region 11 may be based on the first modified gamma curve defined for the first region 11 as illustrated in FIG. 8, and the gamma transformation for the pixel circuits 17 in the second region 12 may be based on the second modified gamma curve defined for the second region 12. The processing performed by the image processing circuitry 25 may further include one or more other processes (e.g., color adjustment, image scaling, etc.), which may be implemented before and/or after the gamma transformation.

The grayscale voltage generator 26 is configured to supply (m+1) grayscale voltages V0 to Vm to the data driver circuitry 27. In various embodiments, the (m+1) grayscale voltages V0 to Vm have different voltage levels from each other. In embodiments where the grayscale voltage V0 is the highest grayscale voltage and the grayscale voltage Vm is the lowest grayscale voltage, the grayscale voltage generator 26 may be configured to generate the highest grayscale voltage V0 and the lowest grayscale voltage Vm and further generate the intermediate grayscale voltages V1 to V(m−1) through voltage dividing of the grayscale voltages V0 and Vm. In such embodiments, the highest grayscale voltage V0 and the lowest grayscale voltage Vm may control the display brightness level since the display brightness level of the display device 100 depends on the range of the output voltages with which the pixel circuits 16 and 17 are programmed or updated.

The voltage level of the highest grayscale voltage V0 may be specified by a top voltage command value Vtop* received from the control circuitry 24, and the voltage level of the lowest grayscale voltage Vm may be specified by a bottom voltage command value Vbot*. In such embodiments, the range of the output voltages, that is, the display brightness level of the display device 100 may be controlled based at least in part on the top voltage command value Vtop* and the bottom voltage command value Vbot*.

The data driver circuitry 27 is configured to generate the output voltages to be provided to the respective pixel circuits 16 and 17 of the display panel 10 based on the output voltage data V_out received from the image processing circuitry 25 and the grayscale voltages V0-Vm received from the grayscale voltage generator 26. The data driver circuitry 27 may be configured to select the grayscale voltages V0 to Vm based on the voltage values specified by the output voltage data V_out for the respective pixel circuits 16 and 17 and output the selected grayscale voltages as the output voltages to be supplied to the respective pixel circuits 16 and 17. In one implementation, the output voltage to be supplied to each pixel circuit 16 or 17 ranges from Vm to V0 and increases as the corresponding voltage value of the output voltage data V_out increases.

The panel interface circuitry 28 is configured to generate the gate scan control signal GSTV, the gate clock GCK, the emission control signal ESTV, and the emission clock ECK to control the scan driver circuitry 15 of the display panel 10. In one or more embodiments, the panel interface circuitry 28 is configured to control the duty ratio of the emission control signal ESTV based on an emission command Emission* received from the control circuitry 24. The emission command Emission* may specify a desired duty ratio of the emission control signal ESTV. In embodiments where the display brightness level of the display device 100 is controllable with the emission control signal ESTV, the display brightness level is controllable with the emission command Emission*.

The panel interface circuitry 28 may be further configured to control the low-side power supply voltage ELVSS based on an ELVSS command ELVSS* received from the control circuitry 24. In such embodiments, the panel interface circuitry 28 may be configured to generate and supply a control signal to the PMIC 400 to adjust the low-side power supply voltage ELVSS as specified by the ELVSS command ELVSS*.

In one or more embodiments, the control circuitry 24 is configured to control the operation of the signal supply circuitry 23 based on the control data D_ctrl received from the external entity 200 via the interface circuitry 21. In embodiments where the control data D_ctrl includes the DBV specified by the external entity 200, the control circuitry 24 may be configured to control the display brightness level of the display device 100 based on the DBV. In one implementation, the control circuitry 24 may be configured to control, based on the DBV, the gamma curve for the gamma transformation by the image processing circuitry 25 to achieve the desired display brightness level. The control circuitry 24 may be further configured to generate the emission command Emission* and/or the ELVSS command ELVSS* based on the DBV to control the display brightness level.

Figure 10:
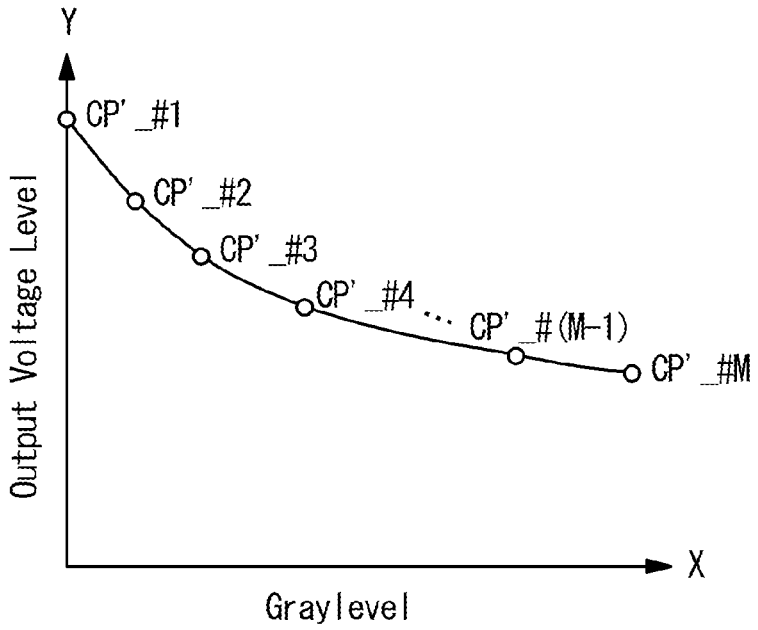
FIG. 10 illustrates an example gamma curve and example control points that define the gamma curve, according to one or more embodiments.

In various embodiments, the gamma curve used in the gamma transformation may be defined with a set of control points. FIG. 10 illustrates an example gamma curve and example control points that define the gamma curve, according to one or more embodiments. In the illustrated embodiment, the shape of the gamma curve is specified with M control points CP'_#1 to CP'_#M, where M is an integer of three or more. The gamma curve may be a free-form curve (e.g., a Bezier curve) defined by the control points CP'_#1 to CP'_#M. The control points CP'_#1 to CP'_#M may be defined in an XY coordinate system defined with an X-axis (or a first axis) that represents graylevels and a Y-axis (or a second axis) that represent output voltage levels. In such embodiments, the locations of the control points CP'_#1 to CP'_#M may be indicated by X and Y coordinates in the XY coordinate system.

Figure 11:
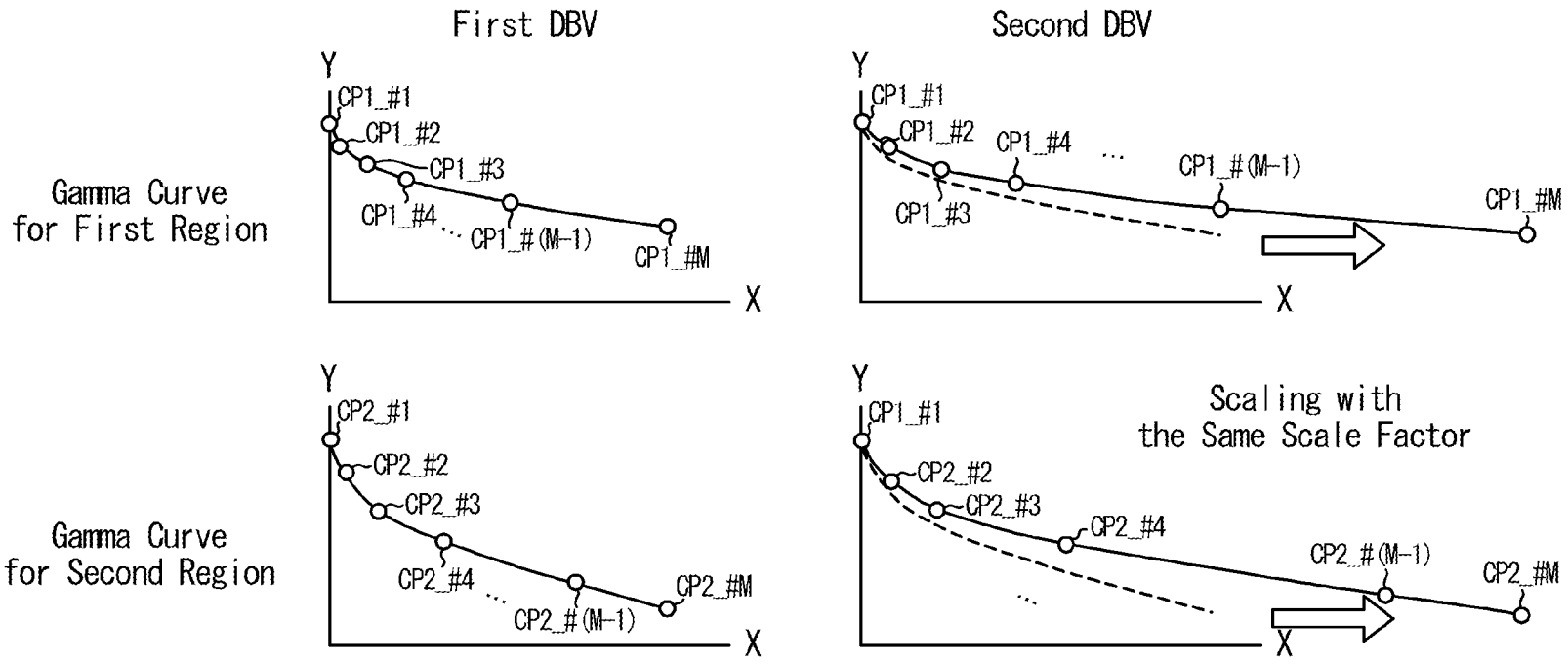
FIG. 11 illustrates example scaling of gamma curves defined for a first region and a second region, according to one or more embodiments.

In embodiments where a gamma curve is defined with a set of control points, the scaling of the gamma curves illustrated in FIG. 8 may be achieved by moving the control points. FIG. 11 illustrates example scaling of gamma curves defined for the first region 11 and the second region 12, according to one or more embodiments. In the illustrated embodiment, control points CP1_#1 to CP1_#M define a gamma curve for a first DBV used in a gamma translation for the first region 11, and control points CP2_#1 to CP2_#M define a gamma curve for the first DBV used in a gamma translation for the second region 12. In one implementation, the scaling of the gamma curves for the first region 11 and the second region 12 with a common scale factor along the X axis is achieved by multiplying the X coordinates of the control points CP1_#1 to CP1_#M and CP2_#1 to CP2_#M by the common scale factor.

Referring back to FIG. 9, the control circuitry 24 may be configured to generate control point data CP'_ctrl that specifies the locations of the control points CP'_#1 to CP'_#M and provide the control point data CP'_ctrl to the image processing circuitry 25. In such embodiments, the image processing circuitry 25 is configured to perform the gamma transformation in accordance with the gamma curve defined with the control points CP1#1 to CP'_#M. The control point data CP'_ctrl may include X coordinate data CPX'_ctrl that specify X coordinates of the control points CP'_#1 to CP'_#M and Y coordinate data CPY'_ctrl that specify Y coordinates of the control points CP'_#1 to CP'_#M.

The control circuitry 24 may be configured to generate the control point data CP'_ctrl used for the gamma transformation applied to the graylevel defined for a target pixel circuit (a pixel circuit 16 or 17) depending on whether the target pixel circuit is located in the first region 11 or the second region 12. This allows using different gamma curves for the first region 11 and the second region 12 as discussed in relation to FIG. 8. In one implementation, the control point data CP'_ctrl are generated by selecting the control points CP1_#1 to CP1_#M for the first region 11 or the control points CP2_#1 to CP2_#M for the second region 12 and multiplying the X coordinates of the selected control points by a scale factor determined based on the DBV.

Figure 12:
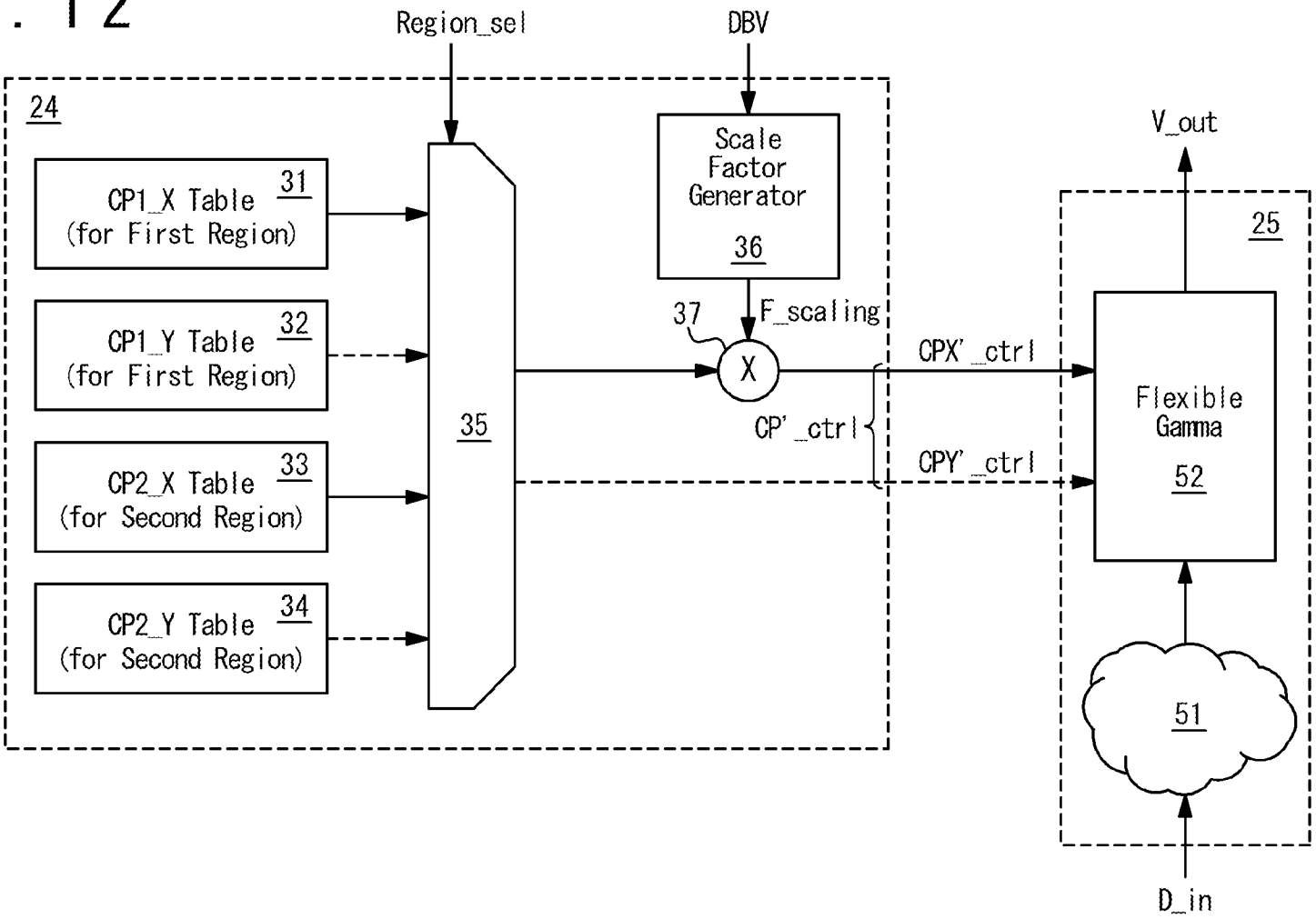
FIG. 12 illustrates example partial configurations of control circuitry and image processing circuitry, according to one or more embodiments.

FIG. 12 illustrates example partial configurations of the control circuitry 24 and the image processing circuitry 25, according to one or more embodiments. In the illustrated embodiment, the image processing circuitry 25 includes an image processing component 51 and flexible gamma circuitry 52. In some embodiments, the image processing component 51 is configured to apply desired image processing (e.g., color adjustment, scaling, and subpixel rendering) to the input image data D_in to generate processed image data. In other embodiments, the image processing component 51 may be omitted. The flexible gamma circuitry 52 is configured to apply the gamma transformation based on the control point data CP'_ctrl to the processed image data received from the image processing component 51 to generate the output voltage data V_out. In other embodiments, the image processing circuitry 25 may further include another image processing component that process the output voltage data V_out.

In the illustrated embodiment, the control circuitry 24 includes a CP1_X table 31, a CP1_Y table 32, a CP2_X table 33, a CP2_Y table 34, a selector 35, a scale factor generator 36, a multiplier 37. The term table refers to any storage mechanism that relates sets of values. The group of tables may be a single storage structure or multiple structures. The CP1_X table 31 and the CP1_Y table 32 are configured to store a first predetermined gamma curve defined for the first region 11 in the form of the control points CP1_#1 to CP1_#M. The CP1_X table 31 includes X coordinates of the control points CP1_#1 to CP1_#M defined for the first region 11, and CP1_Y table 32 includes Y coordinates of the control points CP1_#1 to CP1_#M. In one implementation, the CP1_X table 31 and the CP1_Y table 32 define the X and Y coordinates of the control points CP1_#1 to CP1_#M for the maximum DBV, which corresponds to the maximum display brightness level.

The CP2_X table 33 and the CP2_Y table 34 are configured to store a second predetermined gamma curve defined for the second region 12 in the form of the control points CP2_#1 to CP2_#M. The CP2_X table 33 includes X coordinates of the control points CP2_#1 to CP2_#M defined for the second region 12, and the CP2_Y table 34 includes Y coordinates of the control points CP2_#1 to CP2_#M defined for the second region 12. In one implementation, the CP2_X table 33 and the CP2_Y table 34 define the X and Y coordinates of the control points CP2_#1 to CP2_#M for the maximum DBV.

The selector 35 is configured to select one of the output of the CP1_X table 31 and the output of the CP2_X table 33 in response to a region indicating signal Region_sel. The region indicating signal Region_sel may indicate whether the target pixel circuit is located in the first region 11 or the second region 12. In one implementation, the selector 35 is configured to output the X coordinates of the control points CP1_#1 to CP1_#M from the CP1_X table 31 in response to the region indicating signal Region_sel indicating the target pixel circuit is located in the first region 11 and output the X coordinates of the control points CP2_#1 to CP2_#M from the CP2_X table 33 in response to the region indicating signal Region_sel indicating the target pixel circuit is located in the second region 12.

The selector 35 is further configured to select one of the output of CP1_Y table 32 and the output of CP2_Y table 34 in response to the region indicating signal Region_sel. In one implementation, the selector 35 is configured to output the Y coordinates of the control points CP1_#1 to CP1_#M from the CP1_Y table 32 in response to the region indicating signal Region_sel indicating the target pixel circuit is located in the first region 11 and output the Y coordinates of the control points CP2_#1 to CP2_#M from the CP2_Y table 34 in response to the region indicating signal Region_sel indicating the target pixel circuit is located in the second region 12.

The scale factor generator 36 is configured to generate a scale factor F_scaling based on the DBV. In one implementation, the scale factor generator 36 is configured to determine a target display brightness level for the DBV and generate the scale factor F_scaling based on the target display brightness level. In embodiments where the output voltage level decreases as the graylevel increases (as illustrated in FIGS. 10 and 11), the scale factor F_scaling may be determined as a value of more than 1 that increases as the target display brightness level decreases. In embodiments where the control points CP1_#1 to CP1_#M for the first region 11 and the control points CP2_#1 to CP2_#M for the second region 12 are defined for the maximum DBV that corresponds to the maximum display brightness level, the scale factor F_scaling may be determined in accordance with the following expression (1):

$$F_\text{scaling}=1/(\text{Target}_lux/\text{Max}_lux)^{1/\gamma}, \quad (1)$$

where Target_lux is the target display brightness level; Max_lux is the maximum display brightness level; and $\gamma$ is the gamma value of the display device 100. In one implementation, the gamma value $\gamma$ may be 2.2. The use of the scale factor F_scaling thus determined may maintain the gamma characteristics in the first region 11 and the second region 12 while adjusting the display brightness level.

The multiplier 37 is configured to multiply the X coordinates of the control points selected by the selector 35 by the scale factor F_scaling to determine the X coordinates of the control points CP'_#1 to CP'_#M that defines the gamma curve for the gamma transformation by the flexible gamma circuitry 52. For the pixel circuits 16 in the first region 11, the CP1_X table 31 is selected by the selector 35 based on the region indicating signal Region_sel and the X coordinates of the control points CP'_#1 to CP'_#M are determined as the X coordinates of the control points CP1_#1 to CP1_#M defined for the first region 11 multiplied by the scale factor F_scaling. For the pixel circuits 17 in the second region 12, the CP2_X table 33 is selected and the X coordinates of the control points CP'_#1 to CP'_#M are determined as the X coordinates of the control points CP2_#1 to CP2_#M defined for the second region 12 multiplied by the scale factor F_scaling.

The Y coordinates of the control points selected by the selector 35 are used as the Y coordinates of the control points CP'_#1 to CP'_#M without modification. For the pixel circuits 16 in the first region 11, the CP1_Y table 32 is selected by the selector 35 based on the region indicating signal Region_sel and the Y coordinates of the control points CP1#1 to CP'_#M are determined as the Y coordinates of the control points CP1_#1 to CP1_#M defined for the first region 11. For the pixel circuits 17 in the second region 12, the CP2_Y table 34 is selected, and the Y coordinates of the control points CP'_#1 to CP'_#M are determined as the Y coordinates of the control points CP2_#1 to CP2_#M defined for the second region 12.

The above-described determination of the X and Y coordinates of the control points CP'_#1 to CP'_#M achieves scaling of the gamma curves predetermined for the first region 11 and the second region 12 with the common scale factor F_scaling along the X axis, which represents gray-levels.

Figure 13:
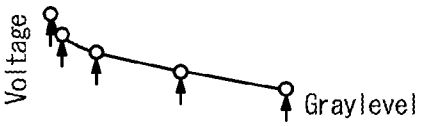
FIG. 13 illustrates an example control of a display brightness level in which the gamma curves for a first region and a second region are scaled based on a DBV, according to one or more embodiments.
Figure 13:
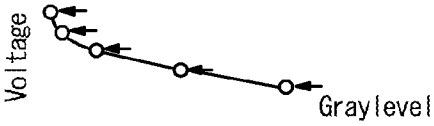
Figure 13:
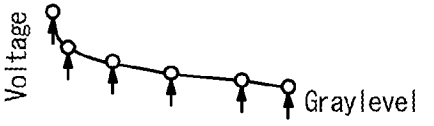
Figure 13:
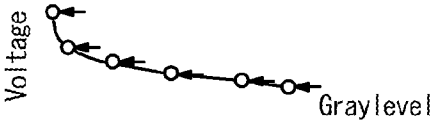

FIG. 13 illustrates an example control of the display brightness level in which the gamma curves for the first region 11 and the second region 12 are scaled along the X axis based on the DBV, according to one or more embodiments. In the illustrated embodiment, the DBV ranges from 0 to the maximum DBV (e.g., 4095 for a 12-bit DBV). The DBV of 0 corresponds to the minimum display brightness level Min_lux and the maximum DBV corresponds to the maximum display brightness level Max_lux. The scale factor F_scaling is determined based on the DBV. In one implementation, a target display brightness level Target_lux is determined for the DBV, and the scale factor F_scaling is determined in accordance with the above-described expression (1). The X coordinates of the control points for the first region 11 are determined using one table, the CP1_X table 31 for the entire range of the DBV, and the X coordinates of the control points for the second region 12 are determined using one table, the CP2_X table 33 for the entire range of the DBV. Similarly, the Y coordinates of the control points for the first region 11 are determined using one table, the CP1_Y table 32 for the entire range of the DBV, and the Y coordinates of the control points for the second region 12 are determined using one table, the CP2_Y table 34 for the entire range of the DBV.

In one or more embodiments, the illustrated control of the gamma curves for the first region 11 and the second region 12 achieves controlling the display brightness level with reduced hardware, while reducing the difference between the brightness in the first region 11 and the second region 12.

Figure 14:
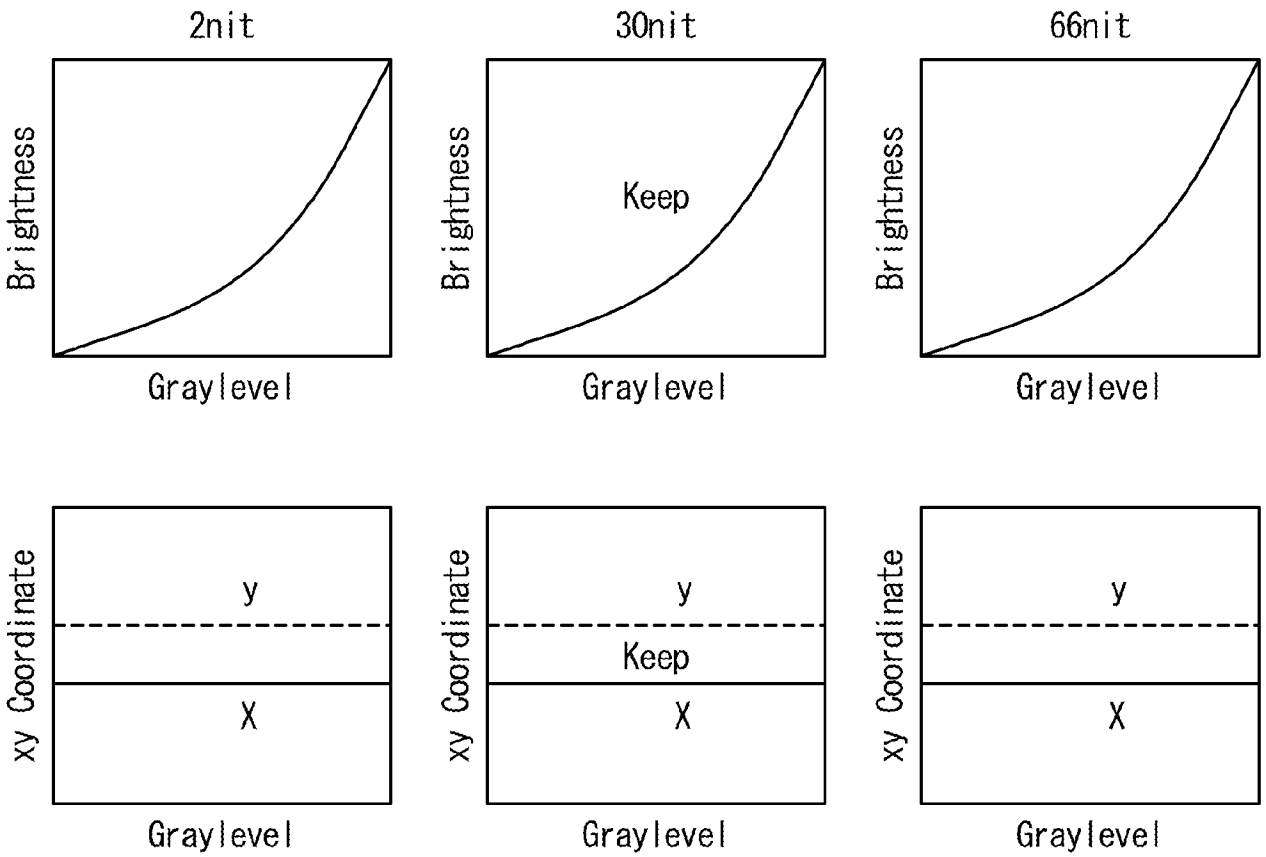
FIG. 14 illustrates gamma characteristics and color coordinates for a fixed color (e.g., white) of a display device, according to one or more embodiments.

Further, in some embodiments, this control may reduce or eliminate a change in the gamma characteristics of the display device 100 as illustrated in the top part of FIG. 14, and/or reduce or eliminate a color change against the DBV as illustrated in the bottom part of FIG. 14, which illustrates that the color coordinates (x, y) are maintained for a fixed color (e.g., white) over the entire ranges of the graylevel and the DBV.

Figure 15:
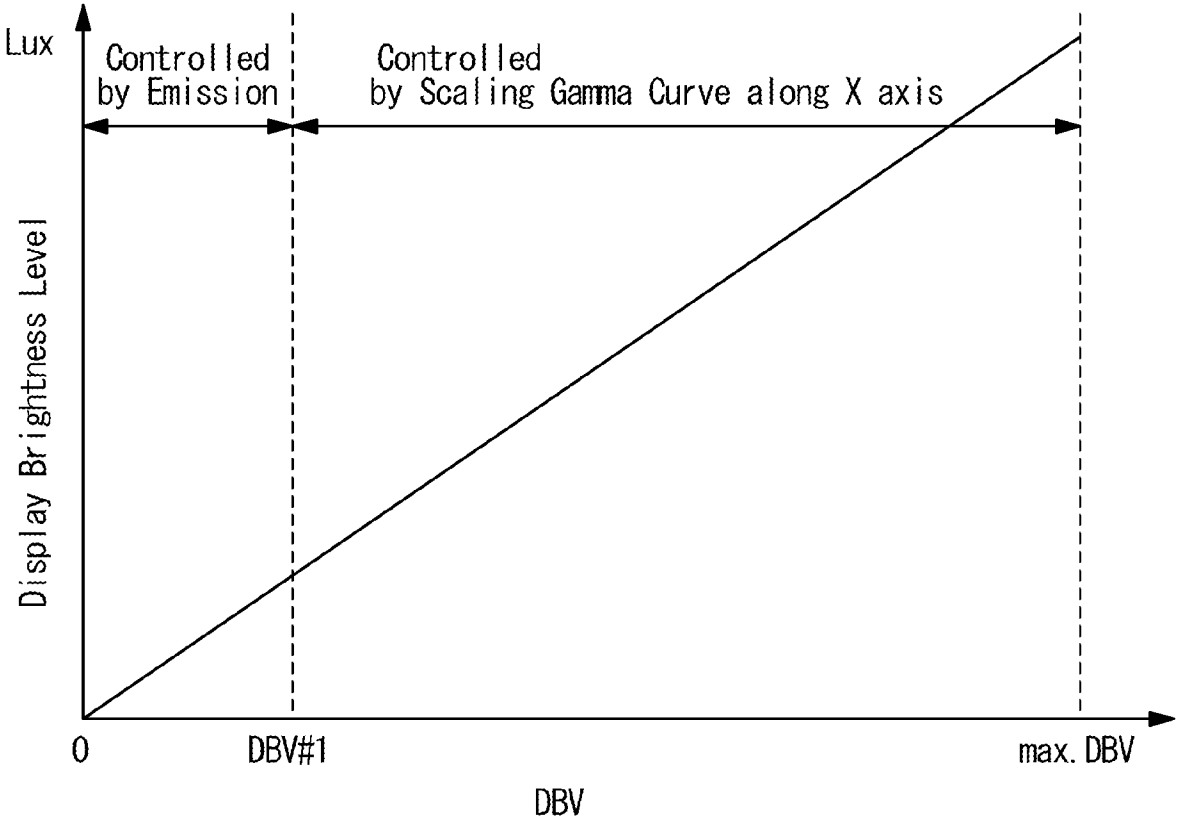
FIG. 15 illustrates an example control of the display brightness level in other embodiments.

FIG. 15 illustrates an example control of the display brightness level in other embodiments. In one or more embodiments, the control of the display brightness level includes emission control that involves adjusting the ratio of the pixel circuits 16 and 17 that emit light to the total number of pixel circuits 16 and 17. In the illustrated embodiment, the emission control is performed in a first DBV range from 0 to DBV #1 as the emission control is suitable for reduced display brightness levels. In various embodiments (e.g., the embodiment illustrated in FIG. 9), the ratio of the pixel circuits 16 and 17 that emit light to the total number of pixel circuits 16 and 17 may be controlled by the duty ratio of the emission control signal ESTV, which controls the number of asserted emission scan lines EM to the total number of the emission scan lines EM. In embodiments where the emission command Emission* specifies a desired duty ratio of the emission control signal ESTV, the duty ratio of the emission control signal ESTV may be controlled by the emission command Emission*. In some embodiments, the emission control is not performed (that is, the ratio of the pixel circuits 16 and 17 that emit light to the total number of pixel circuits 16 and 17 is fixed) in a second DBV range from DBV #1 to the maximum DBV (e.g., 4095 for a 12-bit DBV). In such embodiments, the display brightness level is controlled in the second DBV range by scaling the gamma curves for the first region 11 and the second region 12 as described above.

The above-described emission control may cause different changes in the gamma characteristics between the first region 11 and the second region 12, and this may cause a color shift and/or a brightness difference between the first region 11 and the second region 12.

Figure 16:
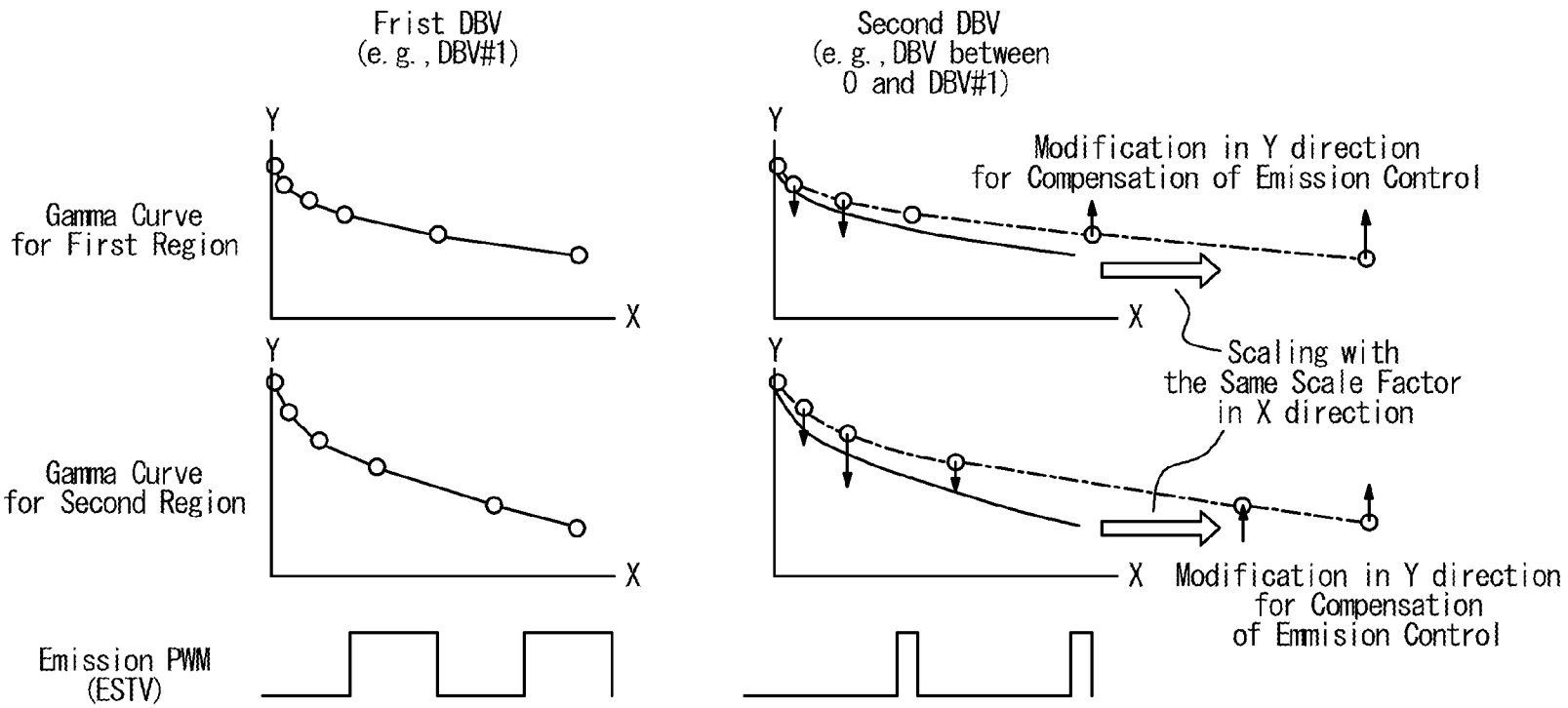
FIG. 16 illustrates example modifications of gamma curves for a first region and a second region of a display panel, according to one or more embodiments.

In one or more embodiments, the gamma curves for the first region 11 and the second region 12 may be modified to mitigate the color shift and/or the brightness difference potentially caused by the emission control in the first DBV range. FIG. 16 illustrates example modifications of the gamma curves for the first region 11 and the second region 12, according to one or more embodiments. In the illustrated embodiments, the emission control signal ESTV has a first duty ratio for a first DBV (e.g., DBV #1) and has a second duty ratio different from the first duty ratio for a second DBV (e.g., a DBV between 0 and DBV #1). In relation to the changes in the duty ratio of the emission control signal ESTV, the gamma curves for the first region 11 and the second region 12 are modified by adjusting the Y coordinates of the control points CP1_#1 to CP1_#M and CP2_#1 to CP2_#M as well as scaling the gamma curves along the X axis based on the scale factor F_scaling.

Figure 17:
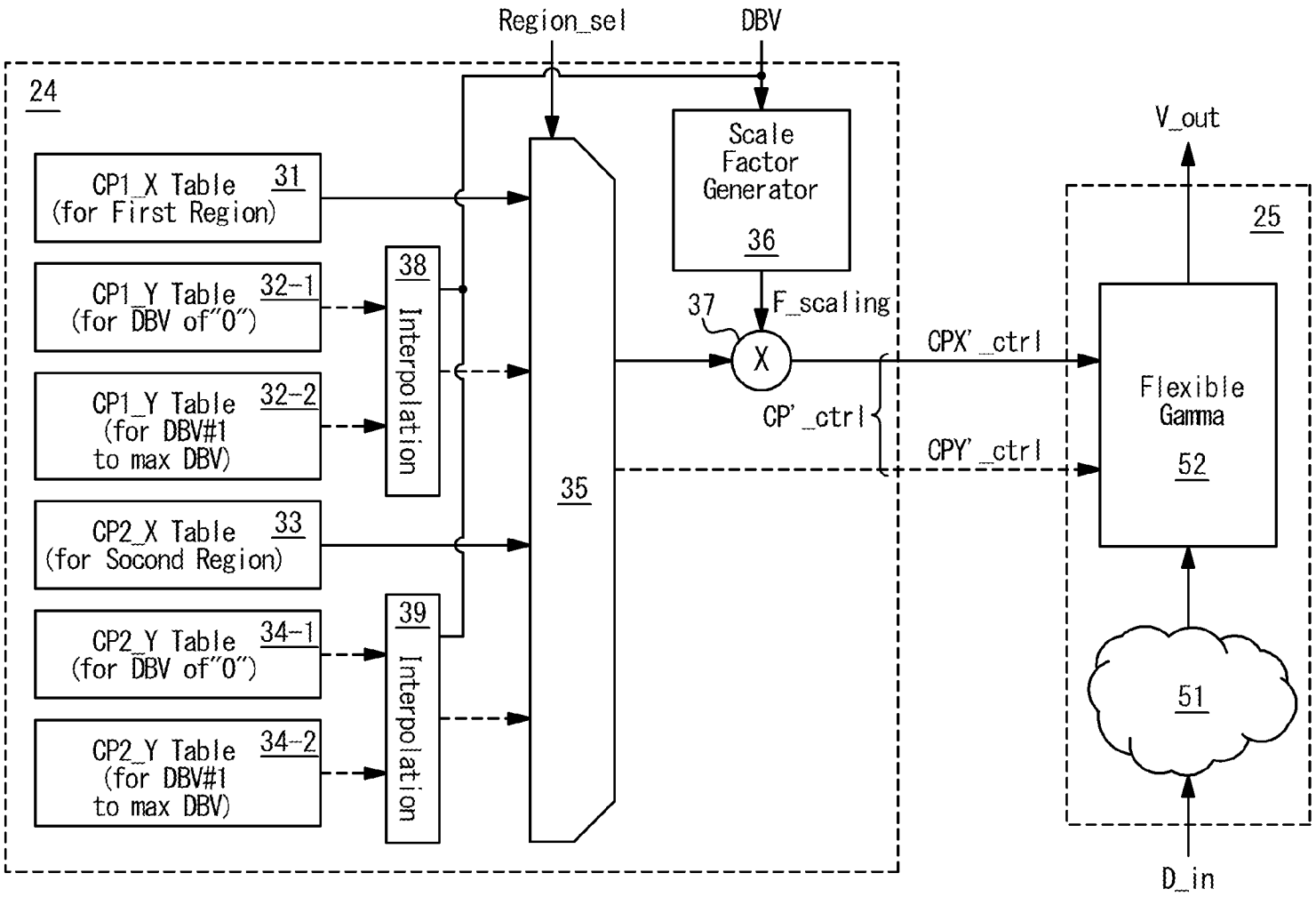
FIG. 17 illustrates an example partial configuration of control circuitry adapted to the modifications of the gamma curves illustrated in FIG. 16, according to one or more embodiments.

FIG. 17 illustrates an example partial configuration of the control circuitry 24 adapted to the modifications of the gamma curves illustrated in FIG. 16, according to one or more embodiments. In the illustrated embodiment, the control circuitry 24 includes a CP1_X table 31, a first CP1_Y table 32-1, a second CP1_Y table 32-2, a CP2_X table 33, a first CP2_Y table 34-1, a second CP2_Y table 34-2, first interpolation circuitry 38, and second interpolation circuitry 39.

The CP1_X table 31 includes X coordinates of the control points CP1_#1 to CP1_#M defined for the first region 11. The CP1_X table 31 is used to determine the X coordinates of the control points CP1_#1 to CP1_#M for the entire DBV range from 0 to the maximum DBV. The first CP1_Y table 32-1 includes Y coordinates of the control points CP1_#1 to CP1_#M for the first region 11 for the DBV of "0", and the second CP1_Y table 32-2 includes Y coordinates of the control points CP1_#1 to CP1_#M for the first region 11 for the second DBV range from DBV #1 to the maximum DBV. The first interpolation circuitry 38 is configured to, when the DBV is in the range of the first DBV range from 0 to DBV #1, determine the Y coordinates of the control points CP1_#1 to CP1_#M for the first region 11 through the interpolation of the Y coordinates received from the first and second CP1_Y tables 32-1 and 32-2 based on the DBV. The first interpolation circuitry 38 is further configured to, when the DBV is in the range of the second DBV range from DBV #1 to the maximum DBV, determine the Y coordinates of the control points CP1_#1 to CP1_#M for the first region 11 as those included in the second CP1_Y table 32-2 without modification.

The CP2_X table 33 includes X coordinates of the control points CP2_#1 to CP2_#M defined for the second region 12. The CP2_X table 33 is used to determine the X coordinates of the control points CP2_#1 to CP2_#M for the entire DBV range from 0 to the maximum DBV. The first CP2_Y table 34-1 includes Y coordinates of the control points CP2_#1 to CP2_#M for the second region 12 for the DBV of "0", and the second CP2_Y table 34-2 includes Y coordinates of the control points CP2_#1 to CP2_#M for the second region 12 used for the second DBV range from DBV #1 to the maximum DBV. The second interpolation circuitry 39 is configured to, when the DBV is in the range of the first DBV range from 0 to DBV #1, determine the Y coordinates of the control points CP2_#1 to CP2_#M for the second region 12 through the interpolation of the Y coordinates received from the first and second CP2_Y tables 34-1 and 34-2 based on the DBV. The second interpolation circuitry 39 is further configured to, when the DBV is in the range of the second DBV range from DBV #1 to the maximum DBV, determine the Y coordinates of the control points CP2_#1 to CP2_#M for the second region 12 as those included in the second CP2_Y table 34-2 without modification.

The selector 35 is configured to select one of the output of the CP1_X table 31 and the output of the CP2_X table 33 in response to a region indicating signal Region_sel. In one implementation, the selector 35 is configured to output the X coordinates of the control points CP1_#1 to CP1_#M from the CP1_X table 31 in response to the region indicating signal Region_sel indicating the target pixel circuit is located in the first region 11 and output the X coordinates of the control points CP2_#1 to CP2_#M from the CP2_X table 33 in response to the region indicating signal Region_sel indicating the target pixel circuit is located in the second region 12.

The selector 35 is further configured to select one of the outputs of the first interpolation circuitry 38 and the second interpolation circuitry 39 in response to the region indicating signal Region_sel. In one implementation, the selector 35 is configured to output the Y coordinates of the control points CP1_#1 to CP1_#M determined by the first interpolation circuitry 38 in response to the region indicating signal Region_sel indicating the target pixel circuit is located in the first region 11 and output the Y coordinates of the control points CP2_#1 to CP2_#M determined by the second interpolation circuitry 39 in response to the region indicating signal Region_sel indicating the target pixel circuit is located in the second region 12.

The scale factor generator 36 is configured to generate a scale factor F_scaling based on the DBV. In some embodiments, the scale factor generator 36 may include an LUT that correlates values of the scale factor F_scaling with values of the DBV to determine the scale factor F_scaling through a table lookup on the LUT with reference to the DBV. In one implementation, the scale factor generator 36 is configured to determine the scale factor F_scaling through a table lookup on the LUT in the first DBV range from 0 to DBV #1 and determine the scale factor F_scaling in accordance with the above-described expression (1) in the second DBV range from DBV #1 to the maximum DBV.

The multiplier 37 is configured to multiply the X coordinates of the control points selected by the selector 35 by the scale factor F_scaling to determine the X coordinates of the control points CP'_#1 to CP'_#M that defines the gamma curve for the gamma transformation by the flexible gamma circuitry 52, as described in relation to FIG. 12. The Y coordinates of the control points selected by the selector 35 are used as the Y coordinates of the control points CP'_#1 to CP'_#M without modification.

Figure 18:
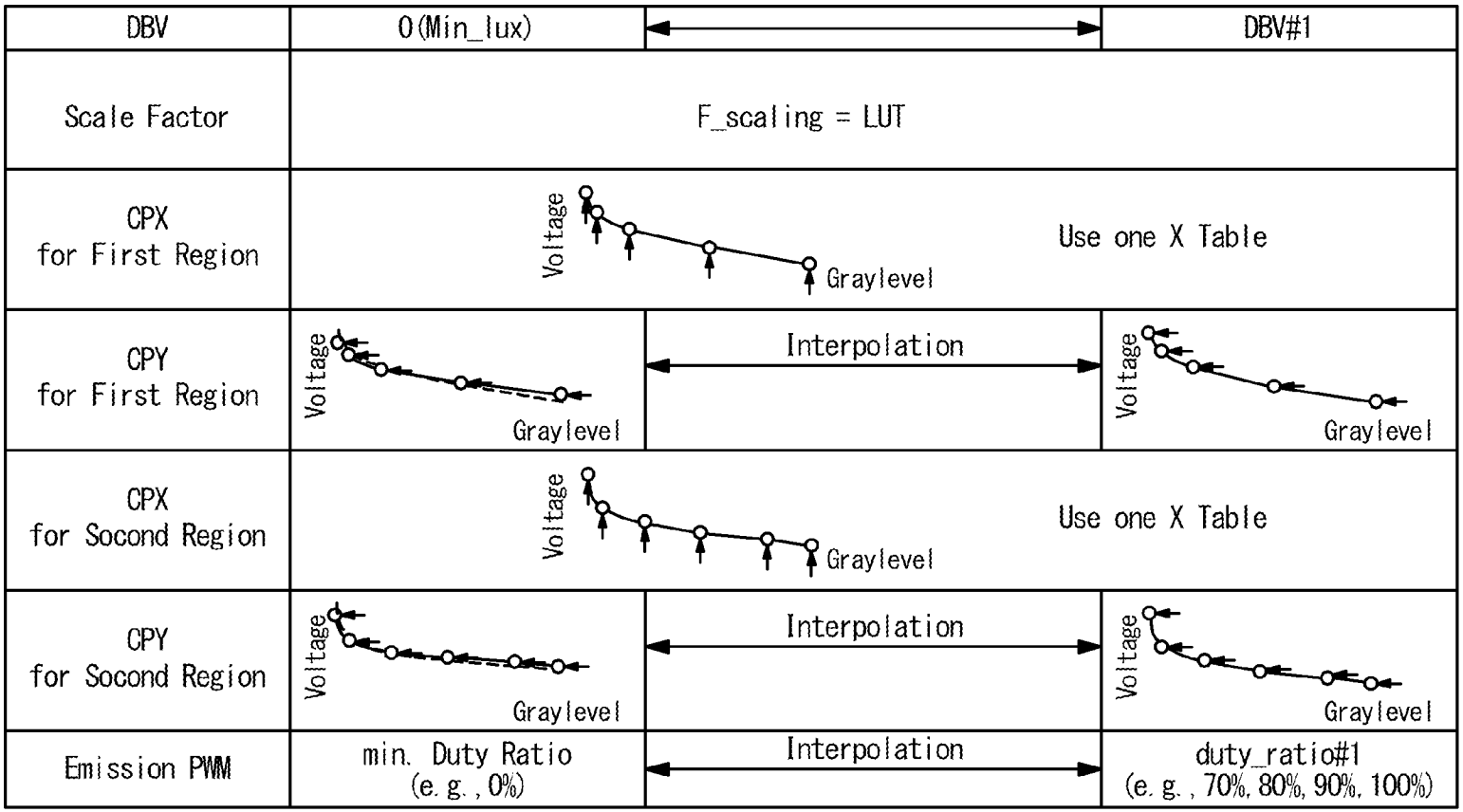
FIG. 18 illustrates an example control of the display brightness level, according to one or more embodiments.

FIG. 18 illustrates an example control of the display brightness level in the first DBV range from 0 to DBV #1, according to one or more embodiments. The duty ratio of the emission control signal ESTV, which is generated through a PWM technique, is adjusted based on the DBV to control the display brightness level in the first DBV range. In the illustrated embodiment, the duty ratio of the emission control signal ESTV is set to the minimum duty ratio (e.g., 0%) for the DBV of 0, and to duty_ratio #1 (e.g., 70%, 80%, 90% or 100%) for DBV #1. The duty ratio of the emission control signal ESTV for a DBV between 0 and DBV #1 may be determined through interpolation of the minimum duty ratio and the maximum duty ratio based on the DBV.

The changes in the duty ratio of the emission control signal ESTV may cause a color shift and/or a brightness difference between the first region 11 and the second region 12. Accordingly, the Y coordinates of the control points CP'_#1 to CP'_#M used for the gamma transformation by the flexible gamma circuitry 52 are adjusted to mitigate or eliminate the color shift and/or the brightness difference. For the first region 11, the Y coordinates of the control points CP1_#1 to CP1_#M are determined by the first interpolation circuitry 38 through interpolation between the Y coordinates described in the first CP1_Y table 32-1, which is prepared for the DBV of 0, and those described in the second CP1_Y table 32-2, which is prepared for DBV #1. For the second region 12, the Y coordinates of the control points CP2_#1 to CP2_#M are determined by the first interpolation circuitry 38 through interpolation between the Y coordinates described in the first CP2_Y table 34-1, which is prepared for the DBV of 0, and those described in the second CP2_Y table 34-2, which is prepared for DBV #1. The Y coordinates of the control points CP'_#1 to CP'_#M used for the gamma transformation by the flexible gamma circuitry 52 are selected between the Y coordinates of the control points CP1_#1 to CP1_#M and those of the control points CP2_#1 to CP2_#M thus determined. This determination scheme of the Y coordinates of the control points CP'_#1 to CP'_#M may effectively mitigate or eliminate the color shift and/or the brightness difference.

In the meanwhile, the scale factor F_scaling is determined through a table lookup on the LUT disposed in the scale factor generator 36 based on the DBV in the first DBV range. The X coordinates of the control points CP'_#1 to CP'_#M used for the gamma transformation by the flexible gamma circuitry 52 are determined by multiplying the X coordinates of the control points CP1_#1 to CP1_#M or CP2_#1 to CP2_#M by the scale factor F_scaling. The X coordinates of the control points for the first region 11 are determined using one table, the CP1_X table 31 for the entire range of the DBV, and the X coordinates of the control points for the second region 12 are determined using one table, the CP2_X table 33 for the entire range of the DBV.

The control of the display brightness level in the second DBV range from DBV #1 to the maximum DBV may be achieved by scaling the gamma curves for the first region 11 and the second region 12 along the X axis as described in relation to FIG. 11, while the duty ratio of the emission control signal ESTV is fixed. For the first region 11, the X coordinates of the control points CP'_#1 to CP'_#M are determined as the X coordinates of the control points CP1_#1 to CP1_#M defined in the CP1_X table 31 multiplied by the scale factor F_scaling, and the Y coordinates of the control points CP1#1 to CP'_#M are determined as the Y coordinates of the control points CP1_#1 to CP1_#M defined in the second CP1_Y table 32-2. For the second region 12, the X coordinates of the control points CP'_#1 to CP'_#M are determined as the X coordinates of the control points CP2_#1 to CP2_#M defined in the CP2_X table 33 multiplied by the scale factor F_scaling, and the Y coordinates of the control points CP'_#1 to CP'_#M are determined as the Y coordinates of the control points CP2_#1 to CP2_#M defined in the second CP2_Y table 34-2. This control scheme allows narrowing the DBV range in which the display brightness level is controlled by the duty ratio of the emission control signal ESTV, effectively reducing a color shift and/or a brightness difference between the first region 11 and the second region 12.

Figure 19:
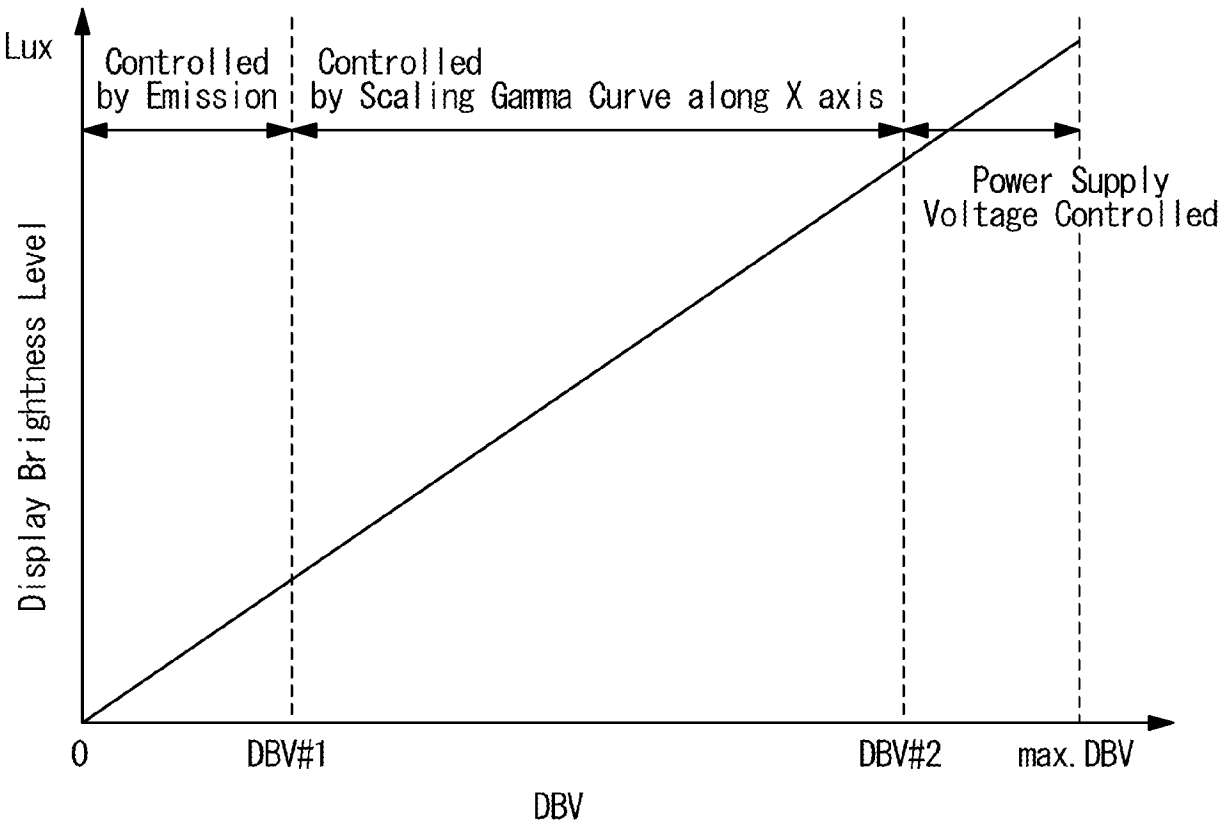
FIG. 19 illustrates an example control of the display brightness level, according to still other embodiments.

FIG. 19 illustrates an example control of the display brightness level, according to still other embodiments. In some embodiments, the luminances of the pixel circuits 16 and 17 of the display panel 10 may depend on the low-side power supply voltage ELVSS supplied to the display panel 10. In such embodiments, the control of the display brightness level may further include adjustment of the low-side power supply voltage ELVSS. The adjustment of the low-side power supply voltage ELVSS may be to achieve a higher display brightness level. In the illustrated embodiment, the low-side power supply voltage ELVSS is adjusted when the DBV is in a third DBV range from DBV #2 to the maximum DBV. Further, the emission control is performed in a first DBV range from 0 to DBV #1, and the scaling of the gamma curves is performed in a second DBV range from DBV #1 to DBV #2. In one or more embodiments, the adjustment of the low-side power supply voltage ELVSS in the third DBV range may be accompanied by adjustment of the gamma curves for the first region 11 and the second region 12 and/or the emission control to mitigate or eliminate a color shift and/or a brightness difference between the first region 11 and the second region 12 potentially caused by the adjustment of the power supply voltage supplied to the display panel 10.

Figure 20:
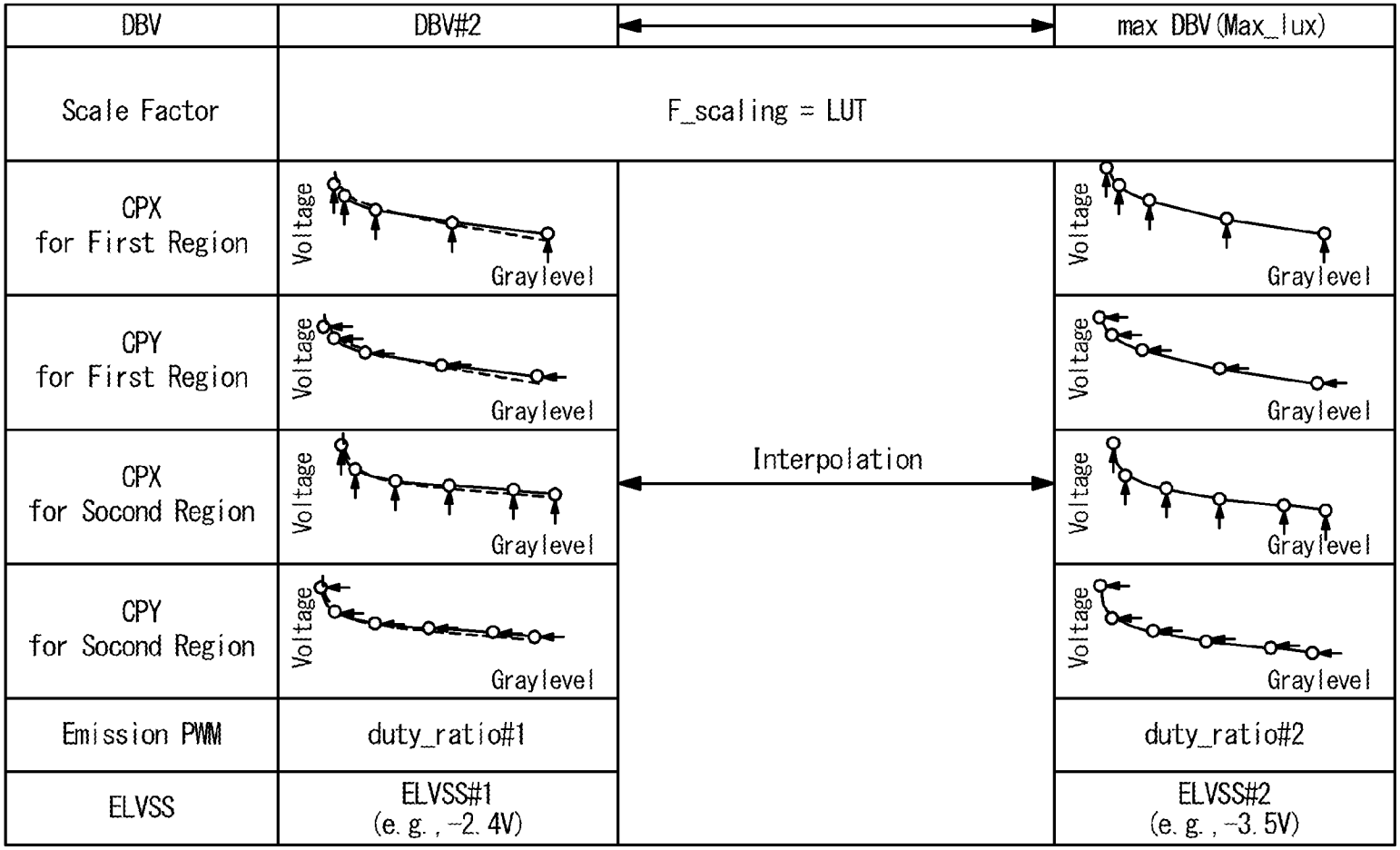
FIG. 20 illustrates an example control of the display brightness level, according to one or more embodiments.

FIG. 20 illustrates an example control of the display brightness level in the third DBV range from DBV #2 to the maximum DBV, according to one or more embodiments. In the illustrated embodiment, the low-side power source voltage ELVSS is adjusted based on the DBV to control the display brightness level in the third DBV range. In the illustrated embodiment, the low-side power source voltage ELVSS is set to ELVSS #1 (e.g., −2.4 V) for DBV #2, and to ELVSS #2 (e.g., −3.5 V) for the maximum DBV. For the DBV between DBV #2 and the maximum DBV, the low-side power source voltage ELVSS is determined through interpolation of ELVSS #1 and ELVSS #2 based on the DBV.

Further, the duty ratio of the emission control signal ESTV is adjusted based on the DBV to control the display brightness level in the first DBV range. In the illustrated embodiment, the duty ratio of the emission control signal ESTV is set to duty_ratio #1 (e.g., 70%, 80%, 90% or 100%) for DBV #2, and to duty_ratio #2 (e.g., 80%, 90%, 100%) for the maximum DBV. For the DBV between DBV #2 and the maximum DBV, the duty ratio of the emission control signal ESTV is determined through interpolation of duty_ratio #1 and duty_ratio #2 based on the DBV.

The changes in the low-side power source voltage ELVSS and the duty ratio of the emission control signal ESTV may cause a color shift and/or a brightness difference between the first region 11 and the second region 12. To mitigate the color shift and/or the brightness difference, the gamma curves defined for the first region 11 and the second region 12 are adjusted based on the DBV. In one or more embodiments, the X coordinates of the control points CP1_#1 to CP1_#M for the first region 11 for a DBV between DBV #2 and the maximum DBV may be determined through interpolation of the X coordinates of the control points CP1_#1 to CP1_#M defined for DBV #2 and the X coordinates of the control points CP1_#1 to CP1_#M defined for the maximum DBV, respectively, and the Y coordinates of the control points CP1_#1 to CP1_#M for the first region 11 for the DBV between DBV #2 and the maximum DBV may be determined through interpolation of the Y coordinates of the control points CP1_#1 to CP1_#M defined for DBV #2 and the Y coordinates of the control points CP1_#1 to CP1_#M defined for the maximum DBV, respectively. The X coordinates of the control points CP2_#1 to CP2_#M for the second region 12 for the DBV between DBV #2 and the maximum DBV may be determined in a similar manner. In such embodiments, the X coordinates of the control points CP2_#1 to CP2_#M for the second region 12 for the DBV between DBV #2 and the maximum DBV may be determined through interpolation of the X coordinates of the control points CP2_#1 to CP2_#M defined for DBV #2 and the X coordinates of the control points CP2_#1 to CP2_#M defined for the maximum DBV, respectively, and the Y coordinates of the control points CP2_#1 to CP2_#M for the second region 12 for the DBV between DBV #2 and the maximum DBV may be determined through interpolation of the Y coordinates of the control points CP2_#1 to CP2_#M defined for DBV #2 and the Y coordinates of the control points CP2_#1 to CP2_#M defined for the maximum DBV, respectively.

Figure 21:
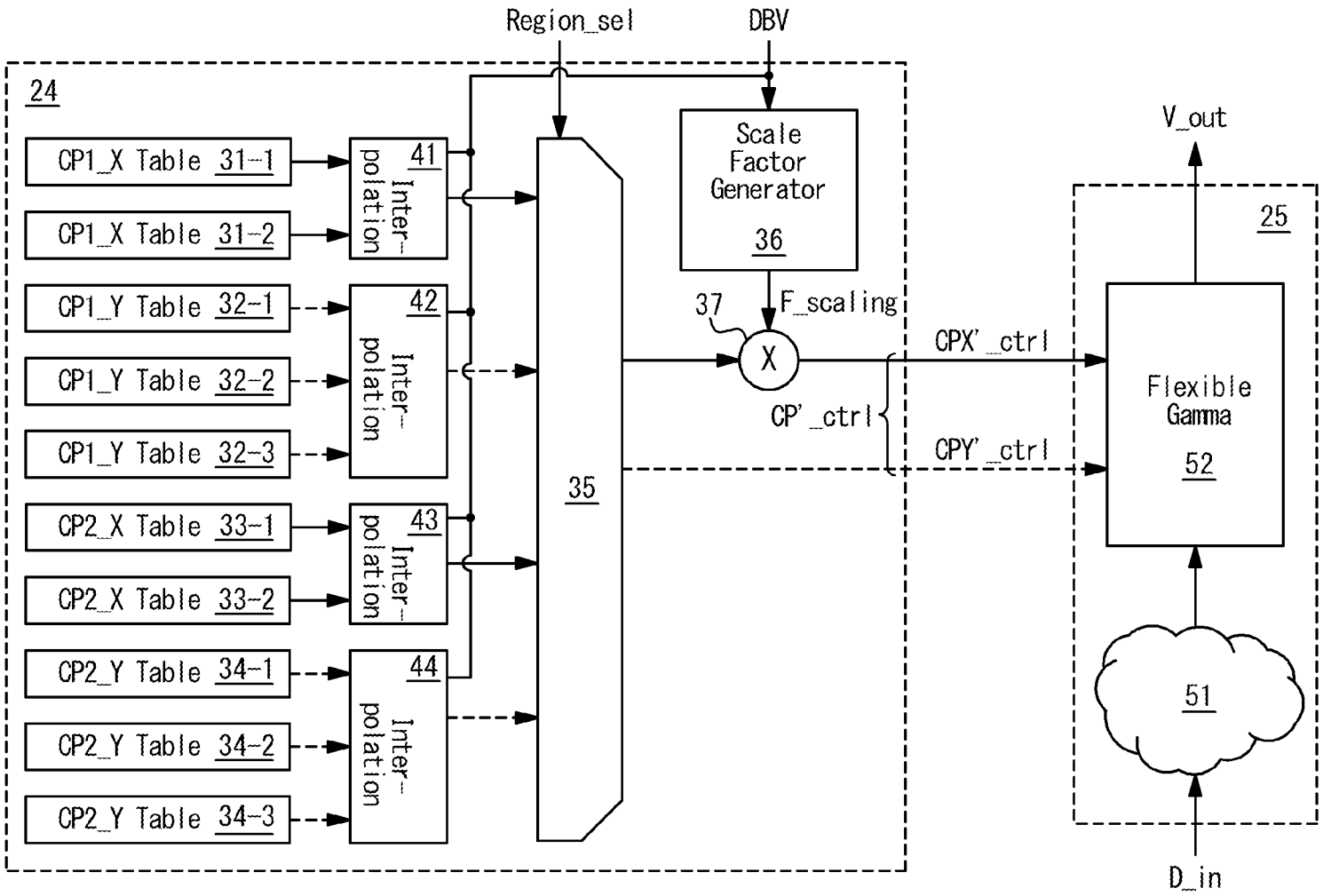
FIG. 21 illustrates an example partial configuration of control circuitry adapted to the display brightness control illustrated in FIGS. 19 and 20, according to one or more embodiments.

FIG. 21 illustrates an example partial configuration of the control circuitry 24 adapted to the display brightness control illustrated in FIGS. 19 and 20, according to one or more embodiments. In the illustrated embodiments, the control circuitry 24 includes a first CP1_X table 31-1, a second CP1_X table 31-2, a first CP1_Y table 32-1, a second CP1_Y table 32-2, a third CP1_Y table 32-3, a first CP2_X table 33-1, a second CP2_X table 33-2, a first CP2_Y table 34-1, a second CP2_Y table 34-2, a third CP2_Y table 34-3, first interpolation circuitry 41, second interpolation circuitry 42, third interpolation circuitry 43, and fourth interpolation circuitry 44.

The first CP1_X table 31-1 includes X coordinates of the control points CP1_#1 to CP1_#M defined for the first region 11 for the DBV range from 0 to DBV #2, and the second CP1_X table 31-2 includes X coordinates of the control points CP1_#1 to CP1_#M defined for the first region 11 for the maximum DBV.

The first interpolation circuitry 41 is configured to, when the DBV is in the range from 0 to DBV #2, determine the X coordinates of the control points CP1_#1 to CP1_#M for the first region 11 as those included in the first CP1_X table 31-1 without modification. The first interpolation circuitry 41 is further configured to, when the DBV is in the range from DBV #2 to the maximum DBV, determine the X coordinates of the control points CP1_#1 to CP1_#M for the first region 11 through the interpolation of the X coordinates received from the first CP1_X tables 31-1 and the second CP1_X table 31-2 based on the DBV.

The first CP1_Y table 32-1 includes Y coordinates of the control points CP1_#1 to CP1_#M for the first region 11 for the DBV of "0"; the second CP1_Y table 32-2 includes Y coordinates of the control points CP1_#1 to CP1_#M for the first region 11 for the DBV range from DBV #1 to DBV #2; and the third CP1_Y table 32-3 includes Y coordinates of the control points CP1_#1 to CP1_#M for the first region 11 for the maximum DBV.

The second interpolation circuitry 42 is configured to, when the DBV is in the range from 0 to DBV #1, determine the Y coordinates of the control points CP1_#1 to CP1_#M for the first region 11 through the interpolation of the Y coordinates received from the first CP1_Y table 32-1 and the second CP1_Y table 32-2 based on the DBV. The second interpolation circuitry 42 is further configured to, when the DBV is in the range from DBV #1 to DBV #2, determine the Y coordinates of the control points CP1_#1 to CP1_#M for the first region 11 as those included in the second CP1_Y table 32-2 without modification. The second interpolation circuitry 42 is further configured to, when the DBV is in the range from DBV #2 to the maximum DBV, determine the Y coordinates of the control points CP1_#1 to CP1_#M for the first region 11 through the interpolation of the Y coordinates received from the second and third CP1_Y tables 32-2 and 32-3 based on the DBV.

The first CP2_X table 33-1 includes X coordinates of the control points CP2_#1 to CP2_#M defined for the second region 12 for the DBV range from 0 to DBV #2, and the second CP2_X table 33-2 includes X coordinates of the control points CP2_#1 to CP2_#M defined for the second region 12 for the maximum DBV.

The third interpolation circuitry 43 is configured to, when the DBV is in the range from 0 to DBV #2, determine the X coordinates of the control points CP2_#1 to CP2_#M for the second region 12 as those included in the first CP2_X table 33-1 without modification. The third interpolation circuitry 43 is further configured to, when the DBV is in the range from DBV #2 to the maximum DBV, determine the X coordinates of the control points CP2_#1 to CP2_#M for the second region 12 through the interpolation of the X coordinates received from the first and second CP2_X tables 33-1 and 33-2 based on the DBV.

The first CP2_Y table 34-1 includes Y coordinates of the control points CP2_#1 to CP2_#M for the second region 12 for the DBV of "0"; the second CP2_Y table 34-2 includes Y coordinates of the control points CP2_#1 to CP2_#M for the second region 12 for the DBV range from DBV #1 to DBV #2; and the third CP2_Y table 34-3 includes Y coordinates of the control points CP2_#1 to CP2_#M for the second region 12 for the maximum DBV.

The fourth interpolation circuitry 44 is configured to, when the DBV is in the range from 0 to DBV #1, determine the Y coordinates of the control points CP2_#1 to CP2_#M for the second region 12 through the interpolation of the Y coordinates received from the first CP2_Y table 34-1 and the second CP2_Y table 34-2 based on the DBV. The fourth interpolation circuitry 44 is further configured to, when the DBV is in the range from DBV #1 to DBV #2, determine the Y coordinates of the control points CP2_#1 to CP2_#M for the second region 12 as those included in the second CP2_Y table 34-2 without modification. The fourth interpolation circuitry 44 is further configured to, when the DBV is in the range from DBV #2 to the maximum DBV, determine the Y coordinates of the control points CP2_#1 to CP2_#M for the second region 12 through the interpolation of the Y coordinates received from the second CP2_Y table 34-2 and the third CP2_Y table 34-3 based on the DBV.

The selector 35 is configured to select one of the outputs of the first interpolation circuitry 41 and the third interpolation circuitry 43 in response to the region indicating signal Region_sel. In one implementation, the selector 35 is configured to output the X coordinates of the control points CP1_#1 to CP1_#M determined by the first interpolation circuitry 41 in response to the region indicating signal Region_sel indicating the target pixel circuit is located in the first region 11 and output the X coordinates of the control points CP2_#1 to CP2_#M determined by the third interpolation circuitry 43 in response to the region indicating signal Region_sel indicating the target pixel circuit is located in the second region 12.

The selector 35 is further configured to select one of the outputs of the second interpolation circuitry 42 and the fourth interpolation circuitry 44 in response to the region indicating signal Region_sel. In one implementation, the selector 35 is configured to output the Y coordinates of the control points CP1_#1 to CP1_#M determined by the second interpolation circuitry 42 in response to the region indicating signal Region_sel indicating the target pixel circuit is located in the first region 11 and output the Y coordinates of the control points CP2_#1 to CP2_#M determined by the fourth interpolation circuitry 44 in response to the region indicating signal Region_sel indicating the target pixel circuit is located in the second region 12.

The scale factor generator 36 is configured to generate a scale factor F_scaling based on the DBV. In some embodiments, the scale factor generator 36 may include an LUT that correlates values of the scale factor F_scaling with values of the DBV to determine the scale factor F_scaling through a table lookup on the LUT with reference to the DBV. In one implementation, the scale factor generator 36 may be configured to determine the scale factor F_scaling through a table lookup on the LUT in the DBV range from 0 to DBV #1 and the DBV range from DBV #2 to the maximum DBV. The scale factor generator 36 may be further configured to determine the scale factor F_scaling in accordance with the above-described expression (1) in the second DBV range from DBV #1 to DBV #2.

The multiplier 37 is configured to multiply the X coordinates of the control points selected by the selector 35 by the scale factor F_scaling to determine the X coordinates of the control points CP'_#1 to CP'_#M that defines the gamma curve used for the gamma transformation by the flexible gamma circuitry 52. The Y coordinates of the control points selected by the selector 35 are used as the Y coordinates of the control points CP'_#1 to CP'_#M without modification.

Figure 22:
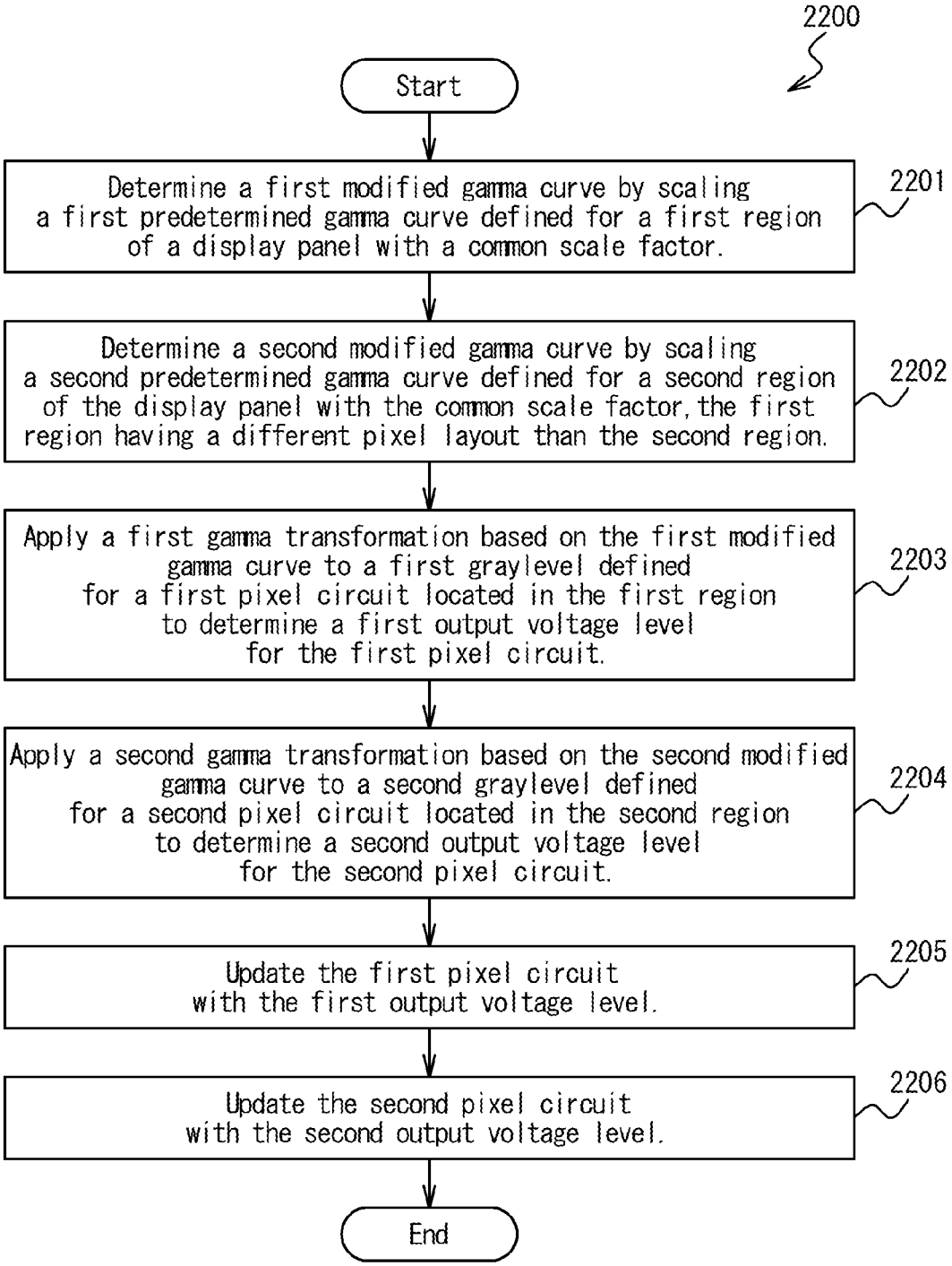
FIG. 22 illustrates an example method for controlling a display panel, according to one or more embodiments.

Method 2200 of FIG. 22 illustrates steps for controlling the display panel 10 (e.g., as illustrated in FIG. 1), according to one or more embodiments. It should be noted that the order of the steps may be altered from the order illustrated. At step 2201, a first modified gamma curve is determined by scaling a first predetermined gamma curve defined for a first region of a display panel with a common scale factor. At step 2202, a second modified gamma curve is determined by scaling a second predetermined gamma curve defined for a second region of the display panel with the common scale factor, the first region having a different pixel layout than the second region. The common scale factor for scaling the second predetermined gamma curve is the same as the common scale factor for scaling the first predetermined gamma curve. At step 2203, a first gamma transformation based on the first modified gamma curve is applied to a first graylevel defined for a first pixel circuit located in the first region to determine a first output voltage level for the first pixel circuit. At step 2204, a second gamma transformation based on the second modified gamma curve is applied to a second graylevel defined for a second pixel circuit located in the second region to determine a second output voltage level for the second pixel circuit. At step 2205, the first pixel circuit is updated with the first output voltage level. At step 2206, the second pixel circuit is updated with the second output voltage level.

While many embodiments have been described, those skilled in the art, having benefit of this disclosure, will appreciate that other embodiments can be devised which do not depart from the scope. Accordingly, the scope of the invention should be limited only by the attached claims.

What is claimed is:

1. A display driver, comprising:

control circuitry configured to:

store a first predetermined gamma curve defined for a first region of a display panel and a second predetermined gamma curve defined for a second region of the display panel, the first region having a different pixel layout than the second region, determine a common scale factor based on a display brightness value (DBV), determine a first modified gamma curve by scaling the first predetermined gamma curve with the common scale factor, and determine a second modified gamma curve by scaling the second predetermined gamma curve with the common scale factor, wherein the common scale factor for scaling the second predetermined gamma curve is the same as the common scale factor for scaling the first predetermined gamma curve; and image processing circuitry configured to:

apply a first gamma transformation based on the first modified gamma curve to a first graylevel defined for a first pixel circuit located in the first region to determine a first output voltage level, and apply a second gamma transformation based on the second modified gamma curve to a second graylevel defined for a second pixel circuit located in the second region to determine a second output voltage level.

2. The display driver of claim 1, wherein the first predetermined gamma curve and the second predetermined gamma curve are scaled with the common scale factor along a first axis that represents graylevels.

3. The display driver of claim 2, wherein the first predetermined gamma curve is defined with a set of first control points, and wherein scaling the first predetermined gamma curve comprises moving the first control points along the first axis based on the common scale factor.

4. The display driver of claim 1, further comprises data driver circuitry configured to:

update the first pixel circuit with the first output voltage level; and update the second pixel circuit with the second output voltage level.

5. The display driver of claim 1, wherein the control circuitry is further configured to:

determine a desired display brightness level of the display panel based on the DBV received from an entity external to the display driver; and determine the common scale factor based on the desired display brightness level.

6. The display driver of claim 1, the control circuitry is further configured to control a ratio of a number of pixel circuits that emit light to a total number of pixel circuits of the display panel; wherein controlling the ratio comprises: controlling the ratio based on the DBV in a first range of the DBV; and maintaining the ratio in a second range of the DBV, wherein the control circuitry is further configured to determine the common scale factor based on the DBV in both the first range and the second range.

7. The display driver of claim 6, wherein the first predetermined gamma curve is defined with a set of first control points, wherein determining the first modified gamma curve comprises modifying locations of the first control points along a second axis that represents output voltage levels.

8. The display driver of claim 7, wherein the control circuitry comprises:

a first lookup table comprising the locations of the first control points along the second axis for a lower limit of the first range of the DBV; and a second lookup table comprising the locations of the first control points along the second axis for an upper limit of the first range of the DBV, and wherein determining the first modified gamma curve is based on the first lookup table and the second lookup table.

9. The display driver of claim 1, the control circuitry is further configured to control a power source voltage supplied to the display panel, wherein controlling the power source voltage comprises:

maintaining the power source voltage in a first range of the DBV, controlling the power source voltage based on the DBV in a second range of the DBV, and wherein the control circuitry is further configured to determine the common scale factor based on the DBV in both the first range and the second range.

10. The display driver of claim 9, wherein the first predetermined gamma curve is defined with a set of first control points, wherein determining the first modified gamma curve comprises modifying locations of the first control points along a second axis that represents output voltage levels.

11. The display driver of claim 10, wherein the control circuitry comprises:

a first lookup table comprising the locations of the first control points for a lower limit of the second range of the DBV; and a second lookup table comprising the locations of the first control points for an upper limit of the first range of the DBV, and wherein determining the first modified gamma curve is based on the first lookup table and the second lookup table.

12. The display driver of claim 1, wherein the second region has a lower pixel density than that of the first region.

13. The display driver of claim 1, wherein the first region comprises a camera hole region under which a camera is disposed.

14. A display device, comprising:

a display panel comprising a first region and a second region, the first region having a different pixel layout than the second region; and a display driver comprising:

control circuitry configured to:

store a first predetermined gamma curve defined for the first region and a second predetermined gamma curve defined for the second region, determine a common scale factor based on a display brightness value (DBV);

determine a first modified gamma curve by scaling the first predetermined gamma curve with the common scale factor, and determine a second modified gamma curve by scaling the second predetermined gamma curve with the common scale factor, wherein the common scale factor for scaling the second predetermined gamma curve is the same as the common scale factor for scaling the first predetermined gamma curve; and image processing circuitry configured to:

apply a first gamma transformation based on the first modified gamma curve to a first graylevel defined for a first pixel circuit located in the first region to determine a first output voltage level, and apply a second gamma transformation based on the second modified gamma curve to a second graylevel defined for a second pixel circuit located in the second region to determine a second output voltage level; and data driver circuitry configured to:

update the first pixel circuit with the first output voltage level, and update the second pixel circuit with the second output voltage level.

15. The display device of claim 14, wherein the first predetermined gamma curve and the second predetermined gamma curve are scaled with the common scale factor along a first axis that represents graylevels.

16. A method, comprising:

determining a common scale factor based on a display brightness value (DBV);

determining a first modified gamma curve by scaling a first predetermined gamma curve defined for a first region of a display panel with the common scale factor;

determining a second modified gamma curve by scaling a second predetermined gamma curve defined for a second region of the display panel with the common scale factor, the first region having a different pixel layout than the second region, wherein the common scale factor for scaling the second predetermined gamma curve is the same as the common scale factor for scaling the first predetermined gamma curve;

applying a first gamma transformation based on the first modified gamma curve to a first graylevel defined for a first pixel circuit located in the first region to determine a first output voltage level for the first pixel circuit; and applying a second gamma transformation based on the second modified gamma curve to a second graylevel defined for a second pixel circuit located in the second region to determine a second output voltage level for the second pixel circuit.

17. The method of claim 16, wherein, scaling the first predetermined gamma curve and the second predetermined gamma curve are scaled with the common scale factor along a first axis that represents graylevel.

* * * * *